US009857730B2

(12) United States Patent
Kato et al.

(10) Patent No.: US 9,857,730 B2
(45) Date of Patent: Jan. 2, 2018

(54) DEVELOPER CONTAINER, DEVELOPING APPARATUS, PROCESS CARTRIDGE, APPARATUS MAIN BODY, AND IMAGE FORMING APPARATUS

(71) Applicant: CANON KABUSHIKI KAISHA, Tokyo (JP)

(72) Inventors: Masahito Kato, Gotemba (JP); Kenta Shibukawa, Mishima (JP); Kazumi Yamauchi, Suntou-gun (JP); Katsuichi Abe, Suntou-gun (JP); Naoya Asanuma, Susono (JP); Atsushi Toda, Fuji (JP); Yosuke Kishi, Suntou-gun (JP); Naoki Fukushima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/007,265

(22) Filed: Jan. 27, 2016

(65) Prior Publication Data

US 2016/0223950 A1 Aug. 4, 2016

(30) Foreign Application Priority Data

Jan. 30, 2015 (JP) ..... 2015-016253
Jan. 30, 2015 (JP) ..... 2015-017025
(Continued)

(51) Int. Cl.
*G03G 15/08* (2006.01)

(52) U.S. Cl.
CPC ..... *G03G 15/0889* (2013.01); *G03G 15/086* (2013.01); *G03G 15/0831* (2013.01);
(Continued)

(58) Field of Classification Search
CPC ..... G03G 15/0831; G03G 15/086; G03G 15/0889; G03G 2215/085; G03G 2215/0888
See application file for complete search history.

(56) References Cited

U.S. PATENT DOCUMENTS 6,246,853 B1 6/2001 Suzuki et al.
6,415,121 B1 7/2002 Suzuki et al.
(Continued)

FOREIGN PATENT DOCUMENTS

EP 1 069 484 A2 1/2001
EP 2 824 515 A2 1/2015
(Continued)

OTHER PUBLICATIONS

Communication in European Patent Application No. 16152345.1, dated Jun. 23, 2016.
(Continued)

*Primary Examiner* — Ryan Walsh
(74) *Attorney, Agent, or Firm* — Fitzpatrick, Cella, Harper & Scinto

(57) ABSTRACT

A developer container includes: a housing chamber 147 which includes an opening 145 and which houses developer; a stirring member 160 which includes a sheet-like stirring portion 160*b* and a rotary shaft 160*a* to which the stirring portion 160*b* is attached; and a first electrode 143 and a second electrode 144 which are used to detect an amount of the developer and which are arranged with an interval therebetween, where in an area X1 between the first electrode 143 and the second electrode 144 in the housing chamber 147 is positioned below the rotary shaft 160*a* of the stirring member 160, and the sheet-like stirring portion 160*b* comes into contact with the area X1 due to rotation of the stirring member 160.

19 Claims, 28 Drawing Sheets

(30) Foreign Application Priority Data

Jan. 30, 2015 (JP) ..... 2015-017226
Dec. 14, 2015 (JP) ..... 2015-243270

(52) U.S. Cl.
CPC ..... *G03G 2215/085* (2013.01); *G03G 2215/0888* (2013.01)

(56) References Cited

U.S. PATENT DOCUMENTS

| | | | | |
|---|---|---|---|---|
| 6,549,223 | B2 | 4/2003 | Yamauchi | |
| 6,654,578 | B2 | 11/2003 | Suzuki et al. | |
| 6,674,975 | B2 | 1/2004 | Yamauchi | |
| 6,850,714 | B2 | 2/2005 | Sakurai et al. | |
| 6,963,714 | B2 | 11/2005 | Otomo et al. | |
| 7,215,904 | B2 | 5/2007 | Hasegawa et al. | |
| 7,274,884 | B2 | 9/2007 | Yamauchi | |
| 7,454,160 | B2 | 11/2008 | Ojima et al. | |
| 7,460,798 | B2 | 12/2008 | Toda et al. | |
| 7,630,678 | B2 | 12/2009 | Kishi et al. | |
| 7,639,956 | B2 | 12/2009 | Naito et al. | |
| 7,773,934 | B2 | 8/2010 | Kishi et al. | |
| 8,036,544 | B2 | 10/2011 | Toda et al. | |
| 8,121,517 | B2 | 2/2012 | Asanuma et al. | |
| 8,139,972 | B2 | 3/2012 | Abe et al. | |
| 8,270,876 | B2 | 9/2012 | Morioka et al. | |
| 8,369,744 | B2 | 2/2013 | Asanuma et al. | |
| 8,472,839 | B2 | 6/2013 | Kishi | |
| 8,688,004 | B2 | 4/2014 | Asanuma et al. | |
| 8,989,629 | B2 | 3/2015 | Kishi et al. | |
| 9,091,962 | B2 | 7/2015 | Masui et al. | |
| 2003/0123888 | A1* | 7/2003 | Naito | G03G 15/086 399/27 |
| 2006/0051135 | A1* | 3/2006 | Sato | G03G 15/0877 399/258 |
| 2006/0067718 | A1 | 3/2006 | Toda et al. | |
| 2013/0039669 | A1 | 2/2013 | Fukushima | |
| 2013/0287452 | A1* | 10/2013 | Yoshida | G03G 15/0806 399/281 |
| 2014/0112686 | A1 | 4/2014 | Asanuma et al. | |
| 2015/0016829 | A1* | 1/2015 | Watanabe | G03G 15/0865 399/27 |

FOREIGN PATENT DOCUMENTS

| | | | |
|---|---|---|---|
| JP | 2-98353 | U | 8/1990 |
| JP | 2001-117346 | A | 4/2001 |
| JP | 2001-290358 | A | 10/2001 |
| JP | 2003-248371 | A | 9/2003 |
| JP | 2007-121646 | A | 5/2007 |

OTHER PUBLICATIONS

Extended Search Report in European Patent Application No. 16152345.1, dated Nov. 30, 2016.

* cited by examiner

DEVELOPER CONTAINER, DEVELOPING APPARATUS, PROCESS CARTRIDGE, APPARATUS MAIN BODY, AND IMAGE FORMING APPARATUS

BACKGROUND OF THE INVENTION

Field of the Invention

The present invention relates to a developer container, a developing apparatus, a process cartridge, an apparatus main body, and an image forming apparatus. Here, a developing apparatus at least includes a developer bearing member that bears developer. Alternatively, a developing apparatus may also include a frame body for housing developer (developer container), a conveying member for conveying the developer, and the like. A cartridge is a piece of equipment which integrates a plurality of components in an image forming apparatus and which is attachable/detachable to/from a main body of the image forming apparatus. A process cartridge at least includes an image bearing member that bears a developer image. In particular, a cartridge which is obtained by integrating an image bearing member and processing means that acts on the image bearing member is referred to as a process cartridge. An image forming apparatus is an apparatus which forms an image on a recording material (transferred material) and is, more specifically, an image forming apparatus such as a copier, a printer, and a facsimile apparatus using an electrophotographic system or an electrostatic recording system.

Description of the Related Art

Conventionally, an image forming apparatus adopting the electrophotographic system is provided with a developing apparatus which forms a developer image by supplying developer to an electrostatic latent image formed by scanning exposure of an image bearing member. In addition, in recent years, there have been many cases where a developing apparatus, an image bearing member, and processing means (charging member and the like) are integrated as a process cartridge. By integrating a plurality of members as a process cartridge and making the process cartridge attachable/detachable to/from an apparatus main body of an image forming apparatus, maintenance work including replenishing developer can be readily performed.

In such a process cartridge system, when developer runs out, images can be formed once again by having a user replace the cartridge or replenish the developer. Therefore, such an image forming apparatus generally includes means for detecting consumption of developer and notifying the user of a placement timing, or in other words, developer amount detecting means. As an example of such developer amount detecting means, Japanese Patent Application Laid-open No. 2001-117346 proposes a plate antenna system which includes a pair of input-side and output-side electrodes and which detects a developer amount by measuring a capacitance between both electrodes.

In addition, Japanese Patent Application Laid-open No. 2003-248371 and Japanese Patent Application Laid-open No. 2007-121646 propose configurations in which a developer bearing member is regarded as an input-side electrode due to application of an AC bias to the developer bearing member and a capacitance detecting portion as an output-side electrode is provided at a location opposing the developer bearing member in a developing apparatus. All of these documents describe systems which detect a developer amount using a change in capacitance that occurs when an amount of developer between a pair of input and output electrodes changes.

SUMMARY OF THE INVENTION

As demonstrated in the configurations described in these documents, since developer amount detection is required to be particularly accurate when only a small amount of the developer remains, a detecting portion must at least be provided at a location where the developer amount changes when the developer is just about to run out. However, when a detecting portion is provided in a container in which developer is stirred by a stirring member, in particular, a state of the developer does not stabilize because the developer is being stirred. Therefore, it is difficult to detect a developer amount with accuracy.

An object of the present invention is to provide a technique capable of improving accuracy of developer amount detection using a stirring member and electrodes provided in a developer housing chamber.

Another object of the present invention is to provide a developer container comprising:

a housing chamber which includes an opening and which houses developer;

a stirring member which includes a sheet-like stirring portion and a rotary shaft to which the stirring portion is attached; and a first electrode and a second electrode which are used to detect an amount of the developer and which are arranged with an interval therebetween, wherein an area between the first electrode and the second electrode in the housing chamber is positioned below the rotary shaft of the stirring member, and the sheet-like stirring portion comes into contact with the area due to rotation of the stirring member.

Another object of the present invention is to provide an apparatus main body of an image forming apparatus to which a cartridge including a housing chamber that houses developer and a plurality of electrodes used to detect an amount of the developer in the housing chamber is mounted and which forms an image on a recording material, wherein a plurality of types of the cartridges with different numbers of the electrodes are configured to be attachable/detachable to the apparatus main body, the apparatus main body comprises a terminal that electrically connects to the electrodes when the cartridge is mounted to the apparatus main body, and the terminal is provided in a number equal to or greater than a largest number among the numbers of the electrodes respectively included in the plurality of types of the cartridges.

Another object of the present invention is to provide an image forming apparatus that forms an image on a recording material, comprising:

an apparatus main body;

a cartridge which includes a housing chamber that houses developer and electrodes used to detect an amount of the developer in the housing chamber and which is configured to be attachable/detachable to/from an apparatus main body; and a terminal which electrically connects the electrodes and the apparatus main body to each other when the cartridge is mounted to the apparatus main body, wherein the apparatus main body is configured such that a plurality of types of the cartridges with different numbers of the electrodes are attachable/detachable to the apparatus main body, and the terminal is provided in the same number as a largest number among the numbers of the electrodes respectively included in the plurality of types of the cartridges.

According to the present invention, accuracy of developer amount detection using a stirring member and electrodes provided in a developer housing chamber can be improved.

Further features of the present invention will become apparent from the following description of exemplary embodiments (with reference to the attached drawings).

DESCRIPTION OF THE EMBODIMENTS

Modes for implementing the present invention will now be exemplarily described in detail based on embodiments with reference to the drawings. It is to be understood that dimensions, materials, shapes, relative arrangements, and the like of components described in the embodiments are intended to be changed as deemed appropriate in accordance with configurations and various conditions of apparatuses to which the present invention is to be applied. In other words, the scope of the pre sent invention is not intended to be limited to the embodiments described below.

First Embodiment

<Outline of Configurations and Operations of Image Forming Apparatus and Process Cartridge>

Figure 2:
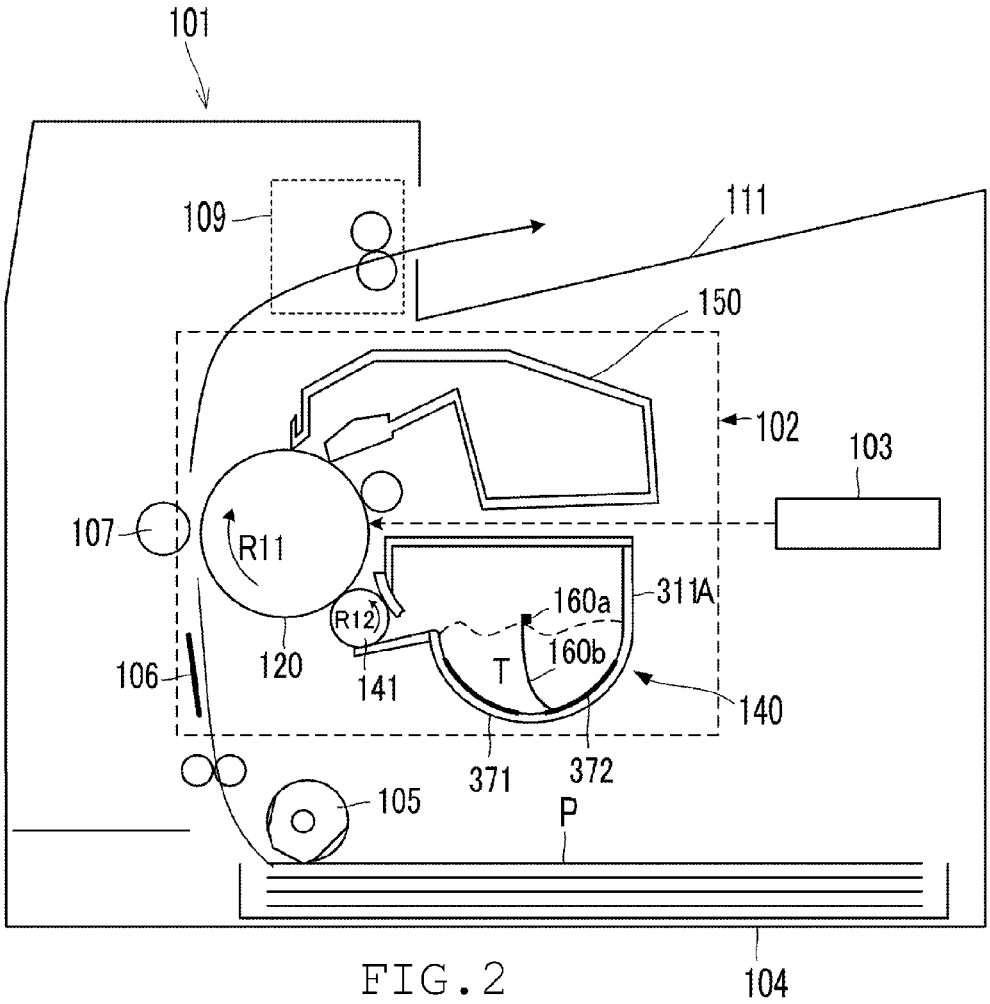
FIG. 2 is a schematic sectional view of an image forming apparatus according to an embodiment of the present invention.

FIG. 2 is a schematic sectional view showing a schematic configuration of an image forming apparatus according to an embodiment of the present invention. The image forming apparatus is a laser beam printer adopting an electrophotographic system and an attachable/detachable process cartridge system. A printer receives and prints image information by being connected to an external host apparatus such as a personal computer or an image reading apparatus. Reference numeral 101 denotes a printer main body (an image forming apparatus main body) and 102 denotes a process cartridge attachable/detachable to/from the printer main body 101.

Figure 3:
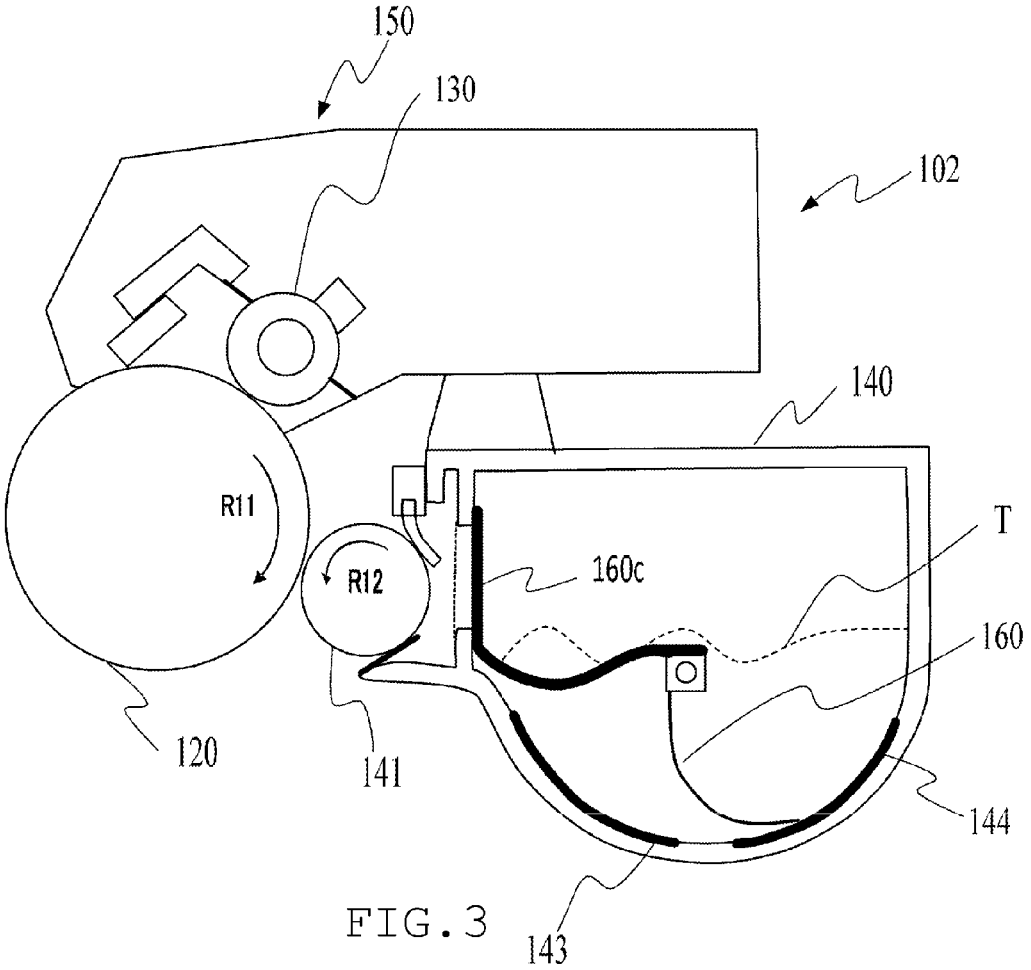
FIG. 3 is a schematic sectional view of a process cartridge according to the first embodiment.

FIG. 3 is a schematic sectional view of a process cartridge according to the first embodiment which will be used to describe the process cartridge 102. Reference numeral 120 denotes a drum-type electrophotographic photosensitive body (hereinafter, referred to as a photosensitive drum) that is an image bearing member. In the present embodiment, four processing apparatuses including the photosensitive drum 120, a charging apparatus 130, a developing apparatus 140, and a cleaning apparatus 150 are integrated into a cartridge to be attachable/detachable to/from the printer main body 101.

Based on a print start signal, the photosensitive drum 120 is rotationally driven clockwise in a direction of an arrow R11 at a circumferential speed (process speed) of 147.6 mm/s. A charging roller that is the charging apparatus 130 to which a charging bias is applied is brought into contact with the photosensitive drum 120. The charging roller 130 is rotationally driven in accordance with the rotation of the photosensitive drum 120. A circumferential surface of the rotating photosensitive drum 120 is uniformly charged to a predetermined polarity and potential by the charging apparatus 130. In the present embodiment, the circumferential surface of the rotating photosensitive drum 120 is charged to a predetermined negative potential. While the charging apparatus 130 in the present embodiment is a contact-charging charging roller, depending on the configuration, a non-contact charging member or a contact charging brush can be used.

A laser scanning exposure of image information is performed by an exposing apparatus (laser scanner unit) 103 on a charged surface of the photosensitive drum 120. Laser light output from the exposing apparatus 103 enters the cartridge and exposes the surface of the photosensitive drum 120. Potential of a portion of the photosensitive drum surface irradiated by the laser light (exposed bright portion) attenuates and an electrostatic latent image (or an electrostatic image) corresponding to the image information is formed on the photosensitive drum surface. The present embodiment adopts an image exposure system which exposes an image information portion. An LED or the like can be used as a light source for exposure. The electrostatic latent image is developed by toner T on a developing sleeve (or a developing roller) 141 as a developer bearing member of the developing apparatus 140.

Meanwhile, a pickup roller 105 of a sheet tray member 104 is driven at a predetermined control timing and one sheet of recording material (paper) that is recording media stacked and housed in the sheet tray member 104 is separated and supplied. As the recording material passes a transfer roller 107 (a transfer nip member where the photosensitive drum 120 and the transfer roller 107 come into contact with each other) via a transfer guide 106, a toner image on the surface of the photosensitive drum 120 is electrostatically transferred onto a surface of the recording material. Subsequently, the recording material that is a transfer material is subjected to a heat and pressure fixing process of the toner image at a fixing apparatus 109 and discharged to a paper discharge tray 111. Residue such as untransferred toner remains on the surface of the photosensitive drum 120 after separation of the sheet material. The residue is removed and cleaned by the cleaning apparatus 150 to be once again repeatedly used for image formation starting from charging.

<Developing Apparatus>

Figure 1:
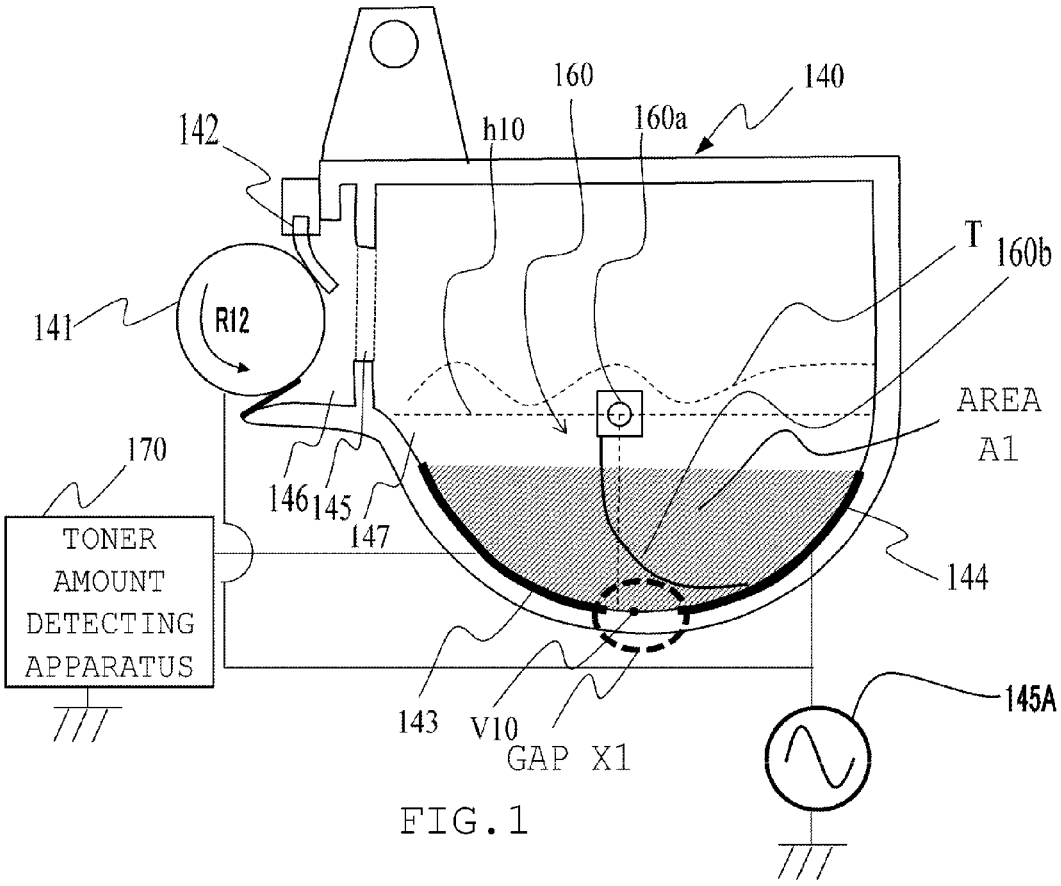
FIG. 1 is a schematic sectional view of a developing apparatus according to a first embodiment.

FIG. 1 is a schematic sectional view of a developing apparatus according to the first embodiment. The developing apparatus 140 according to the present embodiment is constituted by a developing chamber 146 in which a developing sleeve 141 that is a developer bearing member is rotatably arranged and a developer housing chamber 147 for housing toner T that is the developer (hereinafter, referred to as a toner chamber). In addition, the developing apparatus 140 is configured as a developing apparatus (developing unit) that is separate from the cleaning unit. Obviously, a configuration using a process cartridge that integrates a developing apparatus and a cleaning unit may also be adopted.

A magnetic single component toner T in the toner chamber is conveyed by a stirring member 160 to the developing chamber through a toner supply opening 145 that is a communication opening provided between the developing chamber 146 and the toner chamber 147. The toner T in the developing chamber 146 is drawn to a surface of the developing sleeve 141 by a magnet that is a magnetic body enveloped by the developing sleeve 141. Subsequently, with the rotation of the developing sleeve 141 in a direction of R12, the toner T is conveyed in a direction of a developing blade 142 constituted by an elastic member. Then, the toner T is subjected to triboelectricity impartation and layer thickness restriction by the developing blade 142 and conveyed on the surface of the developing sleeve 141 in a direction of the photosensitive drum 120. While a magnetic single component toner is used in the present embodiment, depending on the configuration, a two component toner or a nonmagnetic toner may be used instead.

In this case, a developing bias obtained by superimposing an AC voltage (peak-to-peak voltage=1500 Vpp, frequency f1=2400 Hz) on a DC voltage (Vdc=−400 V) is applied to the developing sleeve 141 from the image forming apparatus main body and the photosensitive drum 120 is grounded. Since an electric field is generated in an area where the photosensitive drum 120 and the developing sleeve 141 oppose each other, a latent image on the surface of the photosensitive drum 120 is developed by the charged toner T described earlier. A developing method is not limited to this method and, depending on the configuration, contact developing may be performed instead.

<Developer Container Enabling Detection of Developer Amount>

Next, a developer container according to the first embodiment will be described with reference to FIG. 1. In the present embodiment, a frame body portion that forms the toner chamber 147 in the frame body of the developing apparatus 140 will be referred to as a developer container. The developer container according to the present embodiment includes a stirring member 160 rotatably provided in the toner chamber 147 (in a housing chamber) and antenna members 143 and 144 as electrodes that are developer amount detecting portions installed along a wall surface (bottom surface) of the toner chamber 147. A developer amount can be detected based on a change in combined capacitance of capacitance between the antenna member 143 (first electrode) and the antenna member 144 (second electrode) and capacitance between the antenna member 143 and the developing sleeve 141 as an electrode.

The antenna member 143 and the antenna member 144 need only have conductive properties and, in the present embodiment, are configured such that a conductive sheet is integrated with a container frame body by insert molding. However, this configuration is not restrictive and other conductive members may be used instead. For example, a conductive resin sheet in which a resin is imparted with conductive properties may be used. In this case, since a sheet shape of a conductive resin sheet can be readily changed during molding and the like, various shapes can be accommodated. For example, as in the case of the present embodiment, a conductive resin sheet can be arranged on a curved surface or a semicircular surface. In addition, if a frame body is made of resin, since a conductive resin sheet is also made based on resin, the frame body and the conductive resin sheet can be integrally formed and, since the frame body and the conductive resin sheet have similar rates of dimensional change due to a change in temperature, peeling and the like are less likely to occur than metal and the like. Furthermore, the antenna member 143 and the antenna member 144 are arranged with an interval therebetween along a container wall surface, and a distance (a distance along a wall surface in a rotating direction of the stirring member 160) of a gap X1 formed on the wall surface is set to 7 mm. In addition, the antenna member 143 and the antenna member 144 are arranged such that the gap X1 is positioned in an area including a lowermost location V10 of the wall surface of the toner chamber 147 in a vertical direction and at a position below a stirring shaft 160*a* of the stirring member 160. In FIG. 1, a height of a center of the stirring shaft 160*a* is depicted by a dashed line h10. In addition, a lower end of the toner supply opening 145 is positioned above the center of the stirring shaft 160*a*. In a similar manner, a lower end of the developing sleeve is positioned above the stirring shaft of the stirring member, thereby adopting a drawing-up configuration in which the toner T is drawn up and supplied to the developing sleeve.

In this case, a bottom surface refers to a portion which is a lower wall surface area among areas opposing each other in a vertical direction on a wall surface forming the toner chamber 147 in the frame body of the developer container (an area opposing a ceiling area of the toner chamber 147) and on which the toner is mounted even if temporarily. In the present embodiment, as shown in FIG. 1, an area approximately below the dashed line h10 on the container frame body wall surface constitutes the bottom surface.

The stirring member 160 is constituted by the stirring shaft 160*a* and a stirring portion 160*b* that is a flexible sheet member. The stirring shaft 160*a* is rotatably supported by the container frame body and, with rotational driving of the stirring shaft 160*a*, the stirring portion 160*b* moves in the toner chamber 147 with the stirring shaft 160*a* as a rotational axis and stirs the toner T in the toner chamber 147. The stirring portion 160*b* is configured so that a tip side thereof slides against at least the bottom surface of the toner chamber 147 and also comes into sliding contact with the antenna members 143 and 144 installed on the bottom surface. The antenna members 143 and 144 and the gap X1 are arranged in an order of the antenna member 144, the gap X1, and the antenna member 143 in a rotating direction of the stirring portion 160*b* which is a direction of movement of the stirring portion 160*b* when positioned below the stirring shaft 160*a*. In the present embodiment, the antenna members 143 and 144 are configured to be exposed on the bottom surface and are in a contacting positional relationship with the stirring portion 160*b*. However, this configuration is not restrictive and, alternatively, a configuration may be adopted in which the antenna members are embedded inside a frame body constituting the bottom surface. In addition, a configuration may be adopted in which the antenna members are glued to a frame body constituting the housing chamber from the outside.

In the configuration according to the present embodiment, the toner supply opening is sealed by a sealing member 160*c* that is a sheet member to ensure that the toner T does not leak from the developing apparatus 140. While an unsealing member must be provided in the apparatus in order to unseal the sealing member 160*c*, in the present embodiment, the stirring member also functions as an unsealing member. Obviously, an unsealing member may be provided separately. A gear that is a drive transfer member attached to the developing apparatus receives drive force from the apparatus main body, and the stirring member that is the unsealing member receives the drive force received by the gear and rotates. Due to the rotation of the stirring member, the sealing member is wound around the stirring member and separated from the wall surface of the toner chamber and, consequently, the sealing member is unsealed.

Figure 4:
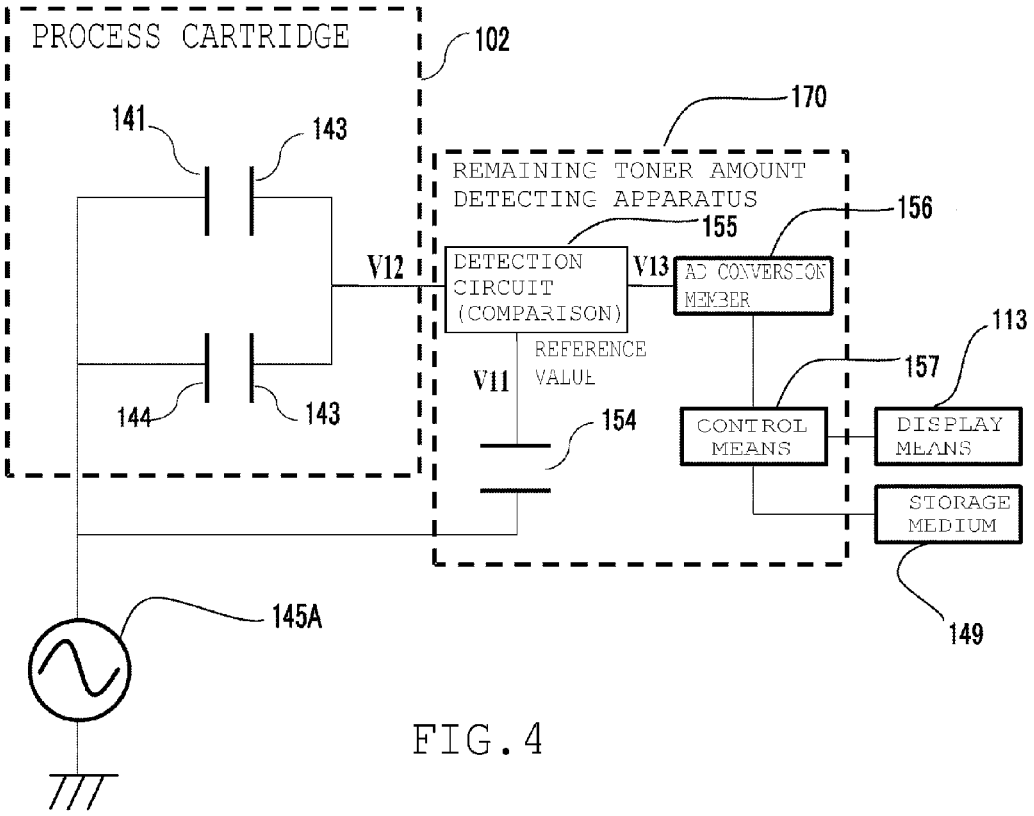
FIG. 4 shows a developer amount detection circuit according to the first embodiment.

FIG. 4 is a circuit configuration diagram of a remaining toner amount detecting apparatus 170 provided in an apparatus main body of the image forming apparatus according to the first embodiment. The circuit configuration is designed to apply a bias for acquiring a signal for detecting an amount of developer to a conducting member that functions as an electrode. In the present embodiment, when a predetermined AC bias is output from an AC power supply 145A as developing bias applying means, the AC bias is respectively applied to a reference capacitor 154, the developing sleeve 141, and the antenna member 144. Accordingly, a voltage V11 is generated on the reference capacitor 154 and a voltage V12 is generated on the antenna member 143 accompanying a current corresponding to capacitance combining capacitance between the antenna member 143 and the developing sleeve 141 and capacitance between the antenna member 143 and the antenna member 144. A detection circuit 155 generates a voltage V13 from a voltage difference between V11 and V12 and outputs the voltage V13 to an AD conversion portion 156. The AD conversion portion 156 outputs a result of digital conversion of the analog voltage V13 to control means 157 (such as a CPU). The control means determines a remaining toner level from the result, stores a result of the determination in a storage medium (such as a RAM or a ROM provided in the apparatus main body), and causes display means 113 (such as a display panel provided on the apparatus main body) to display a remaining amount.

In the present embodiment, the developing sleeve 141 and the antenna member 144 are used as members for applying an AC bias for detecting a remaining toner amount. However, a similar effect to the present embodiment may be obtained even when, for example, an AC bias is not applied to the developing sleeve 141. In addition, an AC bias may be applied to the antenna member 143 and the antenna member 144 may be used as a developer amount detecting portion. However, as in the present embodiment, a favorable arrangement involves arranging the antenna member 143 as a developer amount detecting portion between the developing sleeve 141 and the antenna member 144. Due to this arrangement and configuration, both a change in capacitance between the developing sleeve 141 and the antenna member 143 and a change in capacitance between the antenna member 144 and the antenna member 143 can be detected in an efficient manner.

<Detection of Developer Amount>

Next, validity of the present embodiment will be explained through a detailed description of the detection of a developer amount according to the present embodiment. As shown in FIG. 1, in the present embodiment, the stirring member 160 is arranged such that the stirring portion 160*b* passes in an area A1 sandwiched between the antenna member 143 and the antenna member 144 during rotational driving of the stirring shaft 160*a*. In this case, the area A1 refers to an area in the toner chamber 147 which is below a virtual surface (a virtual line in the sections presented in FIG. 1 and the like) connecting respective upper ends in a vertical direction of the antenna members 143 and 144. The antenna members 143 and 144, the gap X1, and V10 denoting a lowermost portion (deepest location) of the bottom surface are included in the area A1, and the stirring shaft 160*a* is positioned above the area A1 (at a position outside of the area A1).

The present embodiment adopts a configuration in which a developer amount is detected using the fact that a change in a developer amount causes a changes in combined capacitance of capacitance between the antenna member 143 that acts as a developer amount detecting portion and the antenna member 143 and capacitance between the antenna member 143 and the developing sleeve 141. Therefore, when the toner T is stirred with rotational driving of the stirring member 160, a state of the toner in the area A1 changes and, even though the toner amount does not change, an output indicating an apparent change in the toner amount ends up being obtained at a rotational driving cycle of the stirring member 160.

In consideration thereof, in the present embodiment, a configuration is adopted which detects a developer amount by comparing an output value which is an integral multiple of a rotational cycle of the stirring member 160 or which corresponds to an average value of capacitance over a sufficiently long period of time with a relationship between an output value and a developer amount prepared in advance. The larger the amount of change in the output value per a unit amount of change in the toner amount or, in other words, the larger the amount of change in capacitance, the higher the accuracy of developer amount detection that can be performed. Conversely, for example, in a case where capacitance hardly changes even when the toner amount changes, the accuracy of developer amount detection can be assumed to be low.

In addition, generally, since one of the main purposes of performing developer amount detection is to provide the user with a guide for replacing the cartridge, accuracy is favorably high particularly when the amount of toner is small. Therefore, the present embodiment improves accuracy of developer amount detection in the case of a small toner amount by increasing a change in capacitance particularly when the amount of toner is small.

Meanwhile, a relationship between capacitance C1, and an area S and a distance d1 of two antenna members, are known to be described as follows.

$$C1=\in S/d1 \qquad \text{Expression (1)}$$

However, the antenna members according to the present embodiment are arranged along a wall surface of the toner chamber 147 and, for example, contribution to capacitance increases in an area where the distance d1 is shorter and contribution to capacitance decreases in an area where the distance d1 is longer.

Therefore, contribution to a change in capacitance is greater in a vicinity of the gap X1 shown in FIG. 1 and, for example, contribution is small in an upper part of the area A1. A feature of the present embodiment is that the gap X1 exhibiting a large change in capacitance is arranged lower than and directly below the stirring shaft 160*a*. By adopting such a configuration, since the toner drops by its own weight to the vicinity of the gap X1 even during a stirring operation, capacitance changes significantly in response to a change in the toner amount. Therefore, particularly in a state where the amount of toner is small, accuracy of developer amount detection can be improved.

To describe the state shown in FIG. 1 from another perspective, a positional relationship exists where a most proximal interelectrode line segment between electrodes is positioned below the stirring shaft and a straight line in the gravitational direction which passes through the stirring shaft intersects with the interelectrode line segment.

In the present embodiment, the antenna members 143 and 144 are arranged so that the gap X1 is formed in an area including a lowermost position (V) on the wall surface of the toner chamber 147. In this configuration, capacitance changes significantly even if the amount of toner having dropped from the stirring member 160 is extremely small. Therefore, this configuration is more favorable for detecting a remaining toner amount. However, the configuration described above is not restrictive since there are cases where an effect similar to the present embodiment can be obtained even though the gap X1 is somewhat deviated from the lowermost position (V) on the wall surface of the toner chamber 147 as long as the gap X1 is positioned approximately directly below the stirring shaft 160*a*.

<Verification of Improved Accuracy of Developer Amount Detection>

First, details of driving of the stirring member and capacitance according to the present embodiment will be described.

Figure 5:
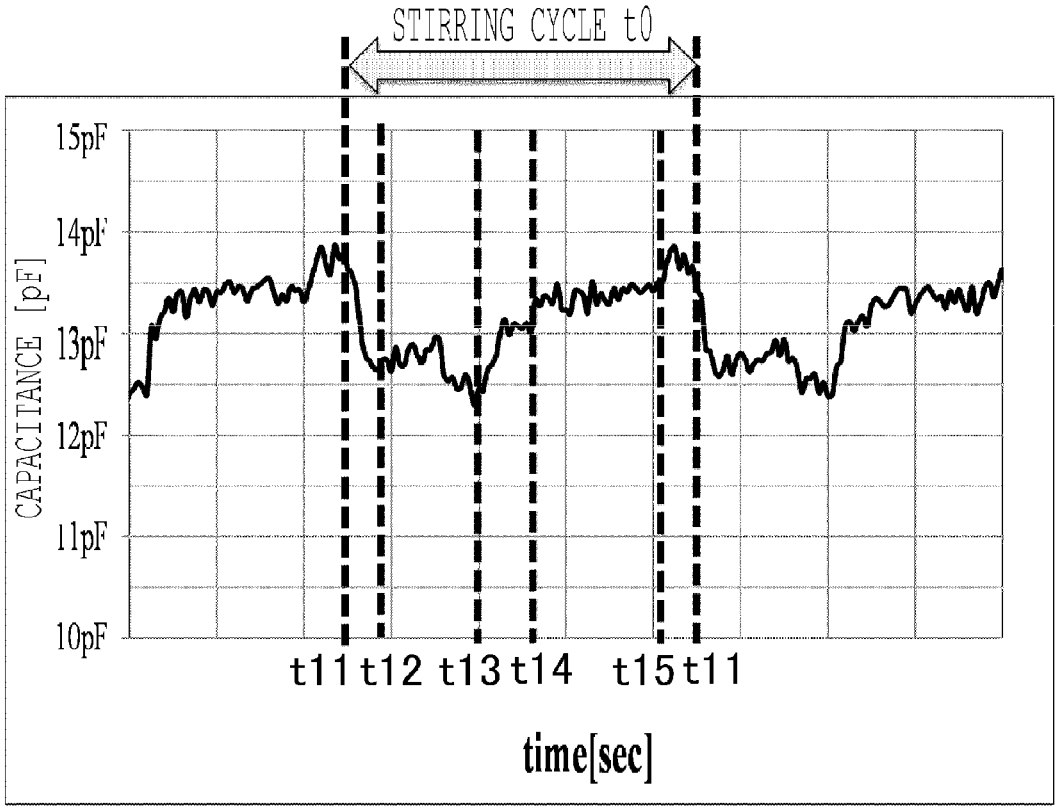
FIG. 5 is a diagram representing a change in capacitance when a stirring member according to the first embodiment is being rotationally driven.

FIG. 5 is a diagram which represents a change in capacitance during rotational driving of the stirring member 160 when the toner amount is 40 g in a configuration according to the present embodiment and which illustrates that changes in capacitance occur cyclically at timings t11 to t15.

Figure 6:
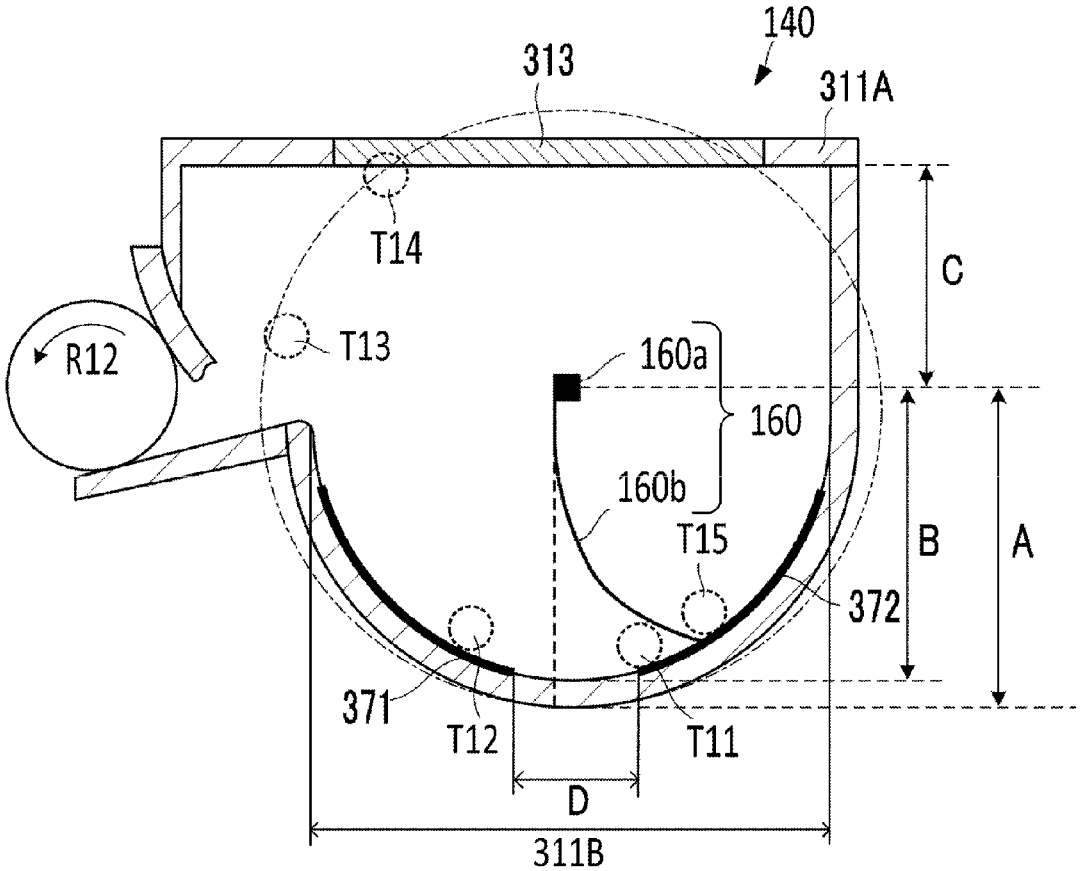
FIG. 6 is a diagram representing rotational drive of a stirring member according to the first embodiment.

FIG. 6 is a schematic sectional view of a developing apparatus according to the present embodiment in which timings at which the stirring portion 160*b* passes in the toner chamber 147 are defined by positions T11 to T15.

A cause of a fluctuation in capacitance that occurs in accordance with driving of the stirring member 160 will be described by determining a correspondence between the relationships shown in FIGS. 5 and 6. In addition, while the 40 g of toner in the container can be divided into toner that moves in the container and toner that does not move in the container due to rotational driving of the stirring member 160, since a change in capacitance will now be described, the description will be limited to moving toner.

As a first point, at a timing where the stirring portion 160*b* passes T11 in FIG. 6, most of the moving toner is gathered in the vicinity of the gap X1. Considering the relationship represented by Expression (1), capacitance takes a maximum value at this timing. Meanwhile, since a local maximum of capacitance corresponds to t11 in FIG. 5, a correspondence is determined between T11 in FIG. 6 and t11 in FIG. 5.

As a second point, at a timing where the stirring portion 160*b* passes T12 in FIG. 6, since most of the moving toner is moved away from the gap X1, capacitance declines rapidly. Since capacitance declines rapidly at t12 in FIG. 5, a correspondence is determined between T12 in FIG. 6 and t12 in FIG. 5.

As a third point, at a timing where the stirring portion 160*b* passes T13 in FIG. 6, since most of the moving toner is lifted up and moved away from the area A1 and toner retained on the SLV is scraped off by the stirring portion 160*b*, capacitance takes a local minimal value. At t13 in FIG. 5, since capacitance takes a local minimal value, a correspondence is determined between T13 in FIG. 6 and t13 in FIG. 5.

As a fourth point, at a timing where the stirring portion 160*b* passes T14 in FIG. 6, most of the toner having been lifted up by the stirring portion 160*b* drops down and falls in a vicinity of the gap X1. Accordingly, since capacitance increases and the stirring portion 160*b* thereafter simply moves midair without holding toner, no change in capacitance occurs. Since capacitance increases at t14 and, subsequently, there is no change in capacitance until t15 in FIG. 5, a correspondence is determined between T14 in FIG. 6 and t14 in FIG. 5.

As a fifth point, at a timing where the stirring portion 160*b* passes T15 in FIG. 6, most of the moving toner is gathered in the gap X1 and capacitance increases. At t15 in FIG. 5, since capacitance increases, a correspondence is determined between T15 in FIG. 6 and t15 in FIG. 5.

Next, a description will be given on improving accuracy of developer amount detection particularly when the amount of toner is small by optimizing a positional relationship between the gap X1 and the stirring shaft 160*a* which is a feature of the present embodiment.

Figure 7:
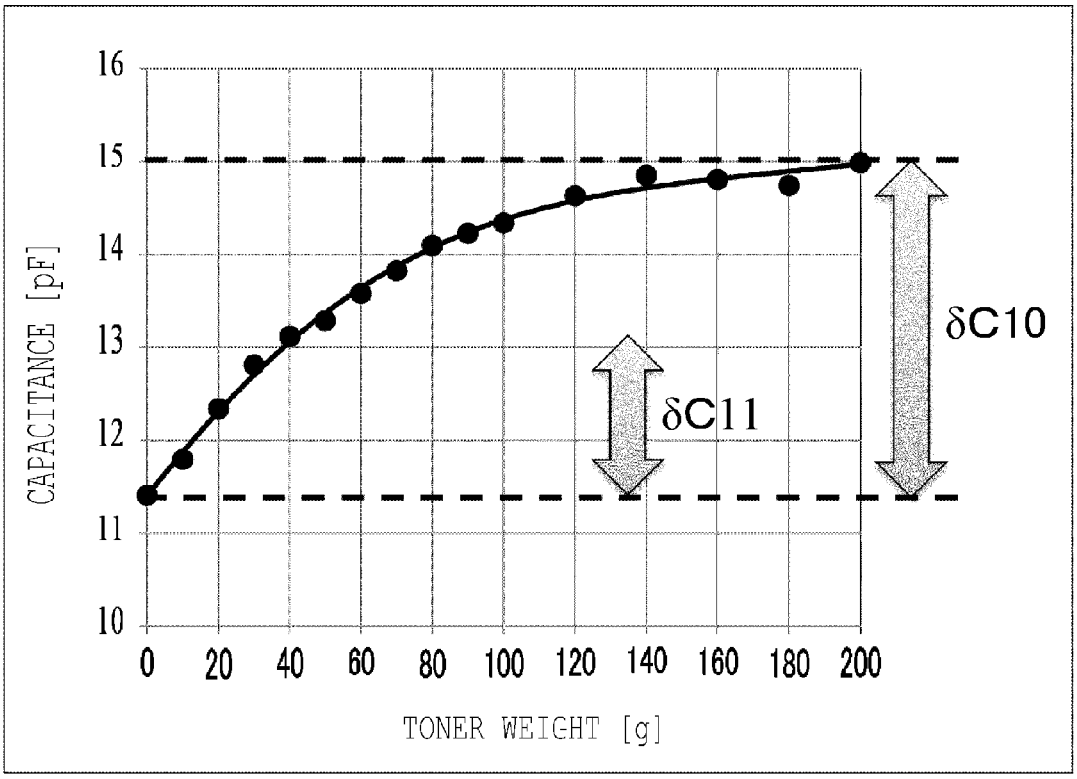
FIG. 7 is a diagram representing a change in developer amount and capacitance according to the first embodiment.

FIG. 7 is a diagram representing a relationship between a toner amount and capacitance according to the present embodiment. As described earlier, in the present embodiment, an effect is obtained in that average capacitance increases even when the toner amount is small at 40 g by causing toner to remain, during a stirring operation, in the gap X1 which has a large contribution to capacitance. Due to this effect, compared to an amount of change in capacitance δC10 being 3.6 pF between when the toner amount is 0 g and when the toner amount is 200 g and capacitance is stable, an amount of change in capacitance δC11 when the toner amount is between 0 g and 40 g is 1.7 pF. This demonstrates that, due to the effect of the present embodiment, a toner amount can be detected at high accuracy by causing capacitance to change significantly in response to a slight change in the toner amount when the toner amount is small.

While vertical axes in FIGS. 5 and 7 represent capacitance, this capacitance combines capacitance in a measurement system of apparatuses other than the developing apparatus in addition to capacitance between electrodes and therefore is a value dependent on the measurement system. Therefore, the values shown in the present specification are numerical values limited to the measurement system used by the present inventors in experiments or the like. However, since a comparison of relative changes in capacitance is sufficient for the purpose of verifying the effect of the present invention, the values are used as examples that demonstrate the effect of the present invention.

Second Embodiment

A second embodiment of the present invention differs from the first embodiment in a configuration of a developer container. Hereinafter, differences from the first embodiment will be described and matters that are similar to those of the first embodiment will not be described. It is to be understood that matters not described here are similar to those described in the first embodiment.

Figure 8:
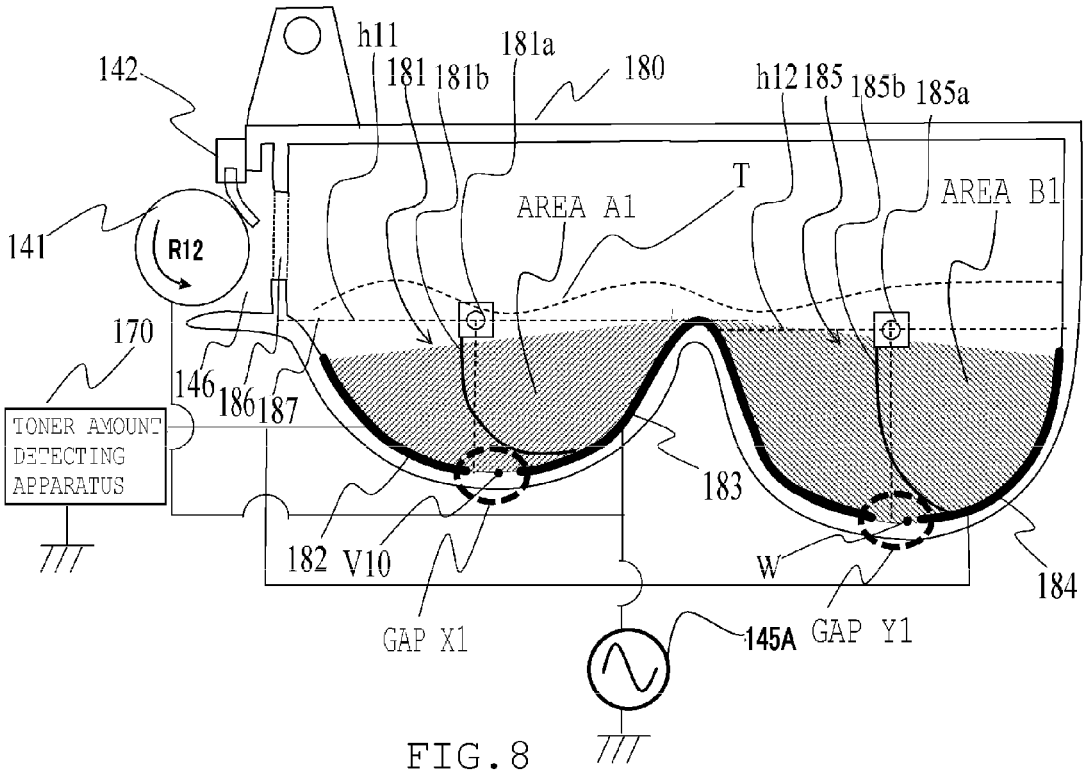
FIG. 8 is a schematic sectional view of a developing apparatus according to a second embodiment.

FIG. 8 is a schematic sectional view of a developing apparatus 180 according to the second embodiment. The second embodiment differs from the first embodiment in that the developer container has a different toner capacity and, accordingly, a stirring member and an electrode have been added. Specifically, in the developing apparatus 180 according to the present embodiment, two stirring members 181 and 185 are respectively rotatably provided in a toner supply chamber 187 and, at the same time, three antenna members 182 to 184 are installed on a bottom surface of the toner supply chamber 187.

The bottom surface of the toner supply chamber 187 of the developing apparatus 180 according to the present embodiment is configured to have two depressed portions that are depressed downward in a vertical direction. The toner supply chamber 187 is configured so as to be approximately divided into an area near a toner supply opening 186 (a first housing area) and a depth-side area that is further away from the toner supply opening 186 (a second housing area) by a convex portion that protrudes upward in the vertical direction from the bottom surface between the two depressed portions.

The first stirring member 181 that is a stirring member is arranged in the first housing area in the toner supply chamber 187 and stirs toner in the first housing area so that the toner in the first housing area is supplied to the developing sleeve 141 via the toner supply opening 186. The first stirring member 181 includes a first stirring shaft 181*a* (first rotary shaft) and a sheet-like first stirring portion 181*b*.

The second stirring member 185 that is a stirring member is arranged in the second housing area in the toner supply chamber 187 and stirs toner in the second housing area so that the toner in the second housing area moves over the convex portion and into the first housing area. The second stirring member 185 includes a second stirring shaft 185*a* (second rotary shaft) and a sheet-like second stirring portion 185*b*.

The antenna member 182 (first electrode) is installed in the first housing area, the antenna member 184 (fourth electrode) is installed in the second housing area, and the antenna member 183 is installed so as to straddle the convex portion and extend in both the first housing area and the second housing area. On the bottom surface of the toner supply chamber 187, a gap X1 is formed between the antenna member 182 and a portion of the antenna member 183 on the side of the first housing area (second electrode) and a gap Y1 is formed between the antenna member 184 and a portion of the antenna member 183 on the side of the second housing area (third electrode). The developing sleeve 141 functions as a fifth electrode.

In the first housing area, the antenna members 182 and 183 and the gap X1 are arranged in an order of the antenna member 183, the gap X1, and the antenna member 182 in a direction of movement of the stirring portion 181*b* (from a distal side toward an opening side of the container) in an area below the stirring shaft 181*a*.

In the second housing area, the antenna members 183 and 184 and the gap Y1 are arranged in an order of the antenna member 184, the gap Y1, and the antenna member 183 in a direction of movement of the stirring portion 185*b* (from a distal side toward an opening side of the container) in an area below the stirring shaft 185*a*.

As shown in FIG. 8, the stirring member 181 is configured such that the stirring portion 181*b* passes in an area A1 sandwiched between the antenna member 182 and a portion of the antenna member 183 on the side of the first housing area during rotational driving of the stirring shaft 181*a*. In this case, the area A1 refers to an area in the first housing area of the toner chamber 147 which is below a virtual surface (a virtual line in the section presented in FIG. 8) connecting respective upper ends in a vertical direction of the antenna members 182 and 183. The antenna member 182, the portion of the antenna member 183 on the side of the first housing area, the gap X1, and V10 denoting a lowermost portion of the bottom surface in the first housing area are included in the area A1, and the stirring shaft 181*a* is positioned above the area A1 (at a position outside of the area A1).

As shown in FIG. 8, the stirring member 185 is configured such that the stirring portion 185*b* passes in an area B1 sandwiched between the antenna member 184 and a portion of the antenna member 183 on the side of the second housing area during rotational driving of the stirring shaft 185*a*. In this case, the area B1 refers to an area in the second housing area of the toner chamber 147 which is below a virtual surface (a virtual line in the section presented in FIG. 8) connecting respective upper ends in a vertical direction of the antenna members 184 and 183. The antenna member 184, the portion of the antenna member 183 on the side of the second housing area, the gap Y1, and W denoting a lowermost portion of the bottom surface in the second housing area are included in the area B1, and the stirring shaft 185*a* is positioned above the area B1 (at a position outside of the area B1).

The developing apparatus 180 according to the present embodiment is configured so that a predetermined AV bias is applied to the antenna member 183 and the developing sleeve 141 from an AC power supply 145A. In addition, the antenna member 182 and the antenna member 184 are electrically connected to each other. Developer amount detection is performed using a change in combined capacitance of capacitance between the antenna member 182 and the portion of the antenna member 183 on the side of the first housing area, capacitance between the developing sleeve 141 and the antenna member 182, and capacitance between the antenna member 184 and the portion of the antenna member 183 on the side of the second housing area.

In the present embodiment, in a similar to the first embodiment, the stirring member 181 is configured to as to pass through the area A1 during rotational driving and the gap X1 is arranged below the stirring shaft 181*a* of the stirring member 181. In FIG. 8, a height of a center of the stirring shaft 181*a* is depicted by a dashed line h11. Furthermore, the gap X1 is positioned below (directly under) the stirring shaft 181*a*. In a similar manner, the stirring member 185 is configured to as to pass through the area B1 during rotational driving and the gap Y1 is arranged below the stirring shaft of the stirring member 185. In FIG. 8, a height of a center of the stirring shaft 181*a* is depicted by a dashed line h12. Furthermore, the gap Y1 is positioned below (directly under) the stirring shaft 185*a*. According to this configuration, in a similar manner to the first embodiment, due to most of toner that falls by its own weight from the stirring portion during a stirring operation dropping in vicinities of the gaps X1 and Y2, a change in capacitance reflecting a change in the toner amount can be further increased and detection accuracy can be improved.

FIG. 9*is* a diagram representing a relationship between a toner amount and an average value of capacitance according to the second embodiment. While a similar effect to the first embodiment is obtained in the present embodiment, the effect is simultaneously obtained at both the gap X1 and the gap Y1 in the present embodiment. The second embodiment differs from the first embodiment in that, when both the stirring member 181 and the stirring member 185 are rotationally driven, toner moves in both the area A1 and the area A2. Therefore, while the effect is obtained when the toner amount is at least 0 g to 40 g in the first embodiment, in the present embodiment, the effect can also be obtained in. for example, an area from 40 g to 200 g in addition to the area from 0 g to 40 g.

While the antenna members are arranged as shown in FIG. 8 in the present embodiment, the antenna members need not necessarily be in this arrangement. For example, a configuration may be adopted in which the antenna member 183 is used as a developer amount detecting portion and an AC bias is applied to the antenna members 182 and 184. In addition, in order to detect both the side of the area A1 and the side of the area B1 in an efficient manner using a smaller number of antenna members, the antenna member 183 need not necessarily be constituted by one sheet (a single electrode member) and may be divided into two sheets at an apex shown in FIG. 8 as long as the two sheets are electrically conductive. However, an arrangement such as that used in the present embodiment is favorable for detecting a change in capacitance between the developing sleeve 141 and the antenna member 182 and a change in capacitance between the areas A1 and B1 in an efficient manner using a smaller number of antenna members.

Figure 9:
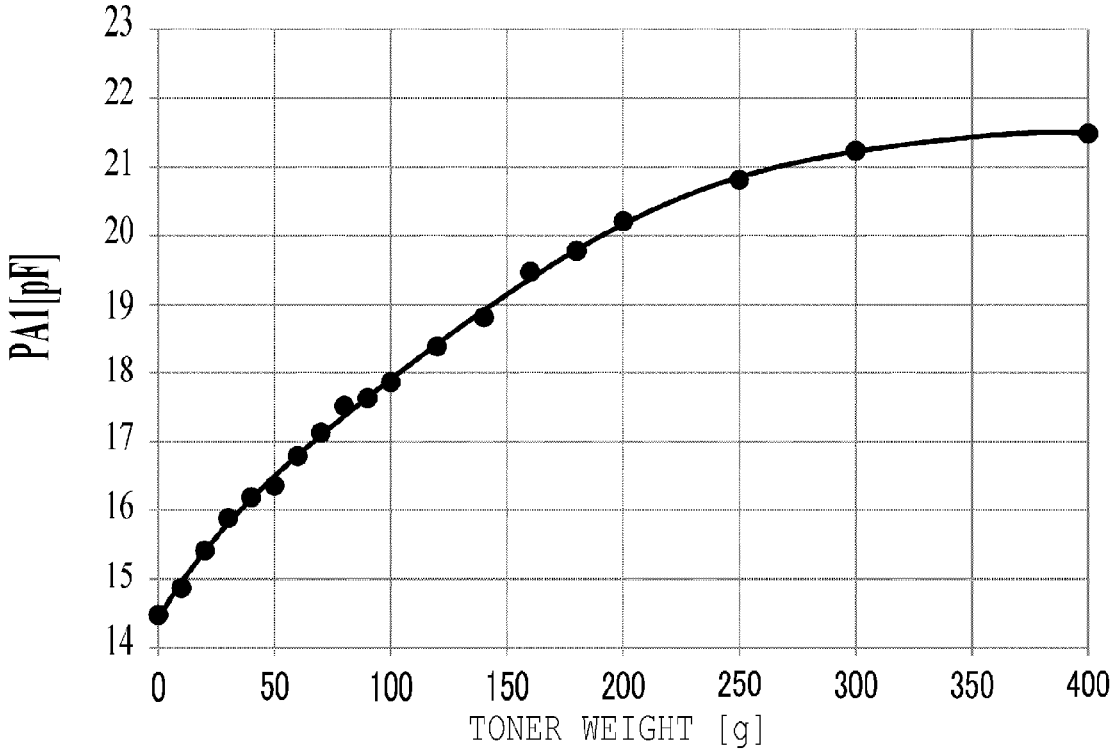
FIG. 9 is a diagram representing a change in developer amount and capacitance according to the second embodiment.

In addition, while a vertical axis in FIG. 9 represents capacitance, this capacitance combines capacitance in a measurement system of apparatuses other than the developing apparatus in addition to capacitance between electrodes and therefore is a value dependent on the measurement system. Therefore, the values shown in the present specification are numerical values limited to the measurement system used by the present inventors in experiments or the like. However, since a comparison of relative changes in capacitance is sufficient for the purpose of verifying the effect of the present invention, the values are used as examples that demonstrate the effect of the present invention.

According to the present invention, a developer container, a developing apparatus, a process cartridge, and an image forming apparatus which enable a developer amount to be detected at high accuracy can be provided.

Third Embodiment

<Configuration of Image Forming Apparatus and Image Forming Process>

Figure 11:
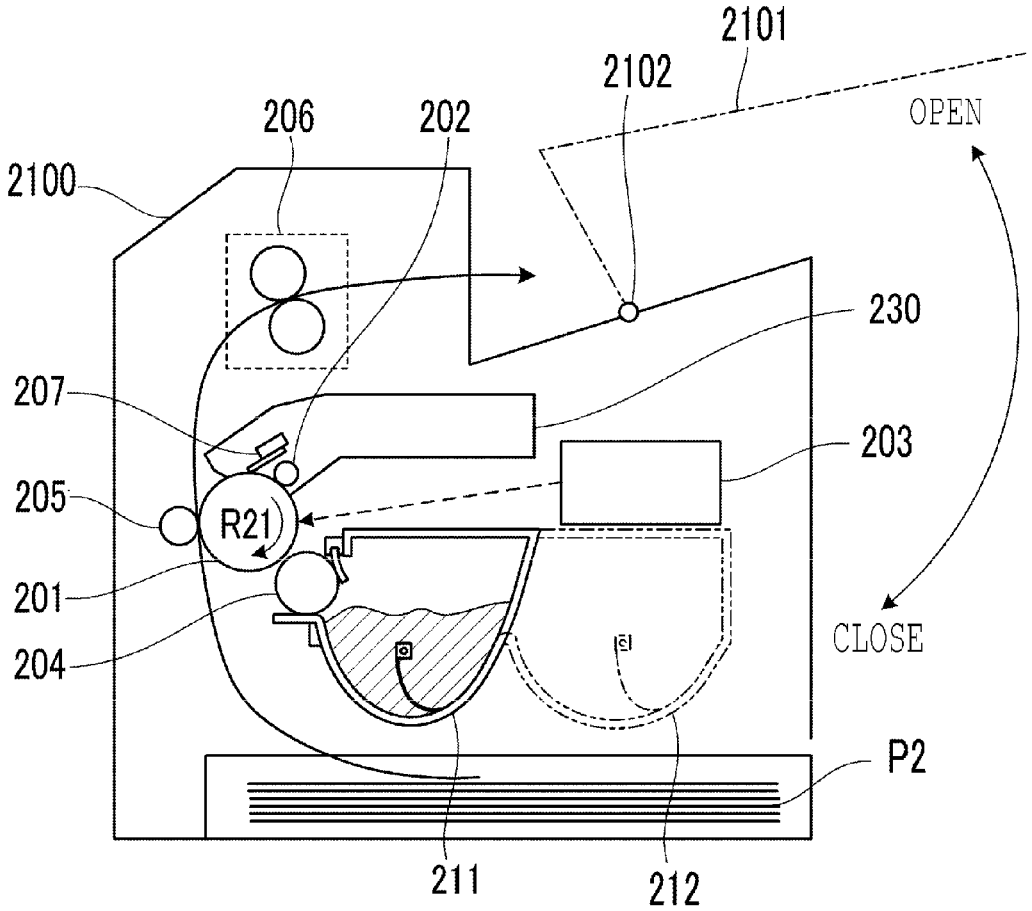
FIG. 11 is a schematic view of an image forming apparatus.

FIG. 11 is a schematic sectional view showing a schematic configuration of an image forming apparatus according to an embodiment of the present invention. The image forming apparatus is a laser beam printer adopting an electrophotographic system. The image forming apparatus is capable of outputting an image based on image information sent from a connected external host apparatus such as a personal computer or an image reading apparatus.

The image forming apparatus according to the present embodiment can be used by selectively mounting a cartridge A2 (FIG. 12) and a cartridge B2 (FIG. 13) on an image forming apparatus main body (hereinafter, referred to as an apparatus main body) 2100. In this case, the cartridge A2 is a process cartridge with a small developer housing amount and the cartridge B2 is a process cartridge with a large developer housing amount. In addition, the cartridges A2 and B2 are respectively units that integrate a photosensitive drum 201, a charging roller 202, a developing apparatus 211 (or a developing cartridge), and a cleaning apparatus 230. These components are assembled in the cartridge in a predetermined mutual arrangement relationship.

An opening/closing cover 2101 of the apparatus main body 2100 can open as depicted by a dot chain line around a hinge shaft member 2102 to open the apparatus main body 2100. This opening enables the cartridge A2 or the cartridge B2 to be inserted and mounted to a predetermined mounting position in the apparatus main body 2100 and, conversely, taken out and removed from the apparatus main body 2100 according to a predetermined procedure. By mounting the cartridge A2 or the cartridge B2 to the apparatus main body 2100, a state is created where the cartridge A2 or the cartridge B2 is mechanically and electrically coupled with the apparatus main body 2100. Accordingly, the image forming apparatus can form images.

The drum-type electrophotographic system (hereinafter, referred to as a photosensitive drum) 201 as an image bearing member is rotationally driven at a predetermined rotational speed in a direction of an arrow R21 based on a print start signal. The charging roller 202 that applies a charging bias is brought into contact with the photosensitive drum 201, and a circumferential surface of the rotating photo sensitive drum 201 is uniformly charged to a predetermined polarity and potential by the charging roller 202 (charging step). With respect to the charged surface, laser scanning exposure of image information is performed by exposing means (hereinafter, referred to as a scanner) 203. The scanner 203 outputs laser light modulated in correspondence to an electric signal of image information input from a host apparatus to perform scanning exposure of the charged surface of the photosensitive drum 201 and, as a result, an electrostatic latent image (electrostatic image) made up of a bright area potential portion and a dark area potential portion is formed on the circumferential surface of the photosensitive drum 201 (exposing step). The electrostatic latent image is developed by a developing sleeve 204 (developer bearing member) of the developing apparatus 211 or the developing apparatus 221. The developing sleeve 204 is arranged so as to oppose the photosensitive drum 201 and bears developer. The electrostatic latent image is developed by the developing sleeve 204 and a toner image (developer image) is formed on the circumferential surface of the photosensitive drum 201 (developing step).

A transfer roller 205 that is roller-like transfer means is arranged so as to oppose the photosensitive drum 201. When a recording material P2 conveyed to the transfer roller 205 passes the transfer roller 205 at a predetermined control timing, a transfer bias is applied to the transfer roller 205 and the toner image on the circumferential surface of the photosensitive drum 201 is electrostatically transferred to a surface of the recording material P2 (transferring step). The recording material P2 after the transferring step is conveyed to fixing means that includes a roller-like heating member and a roller-like pressurizing member, and the fixing means performs a heat and pressure fixing process on the toner image on the recording material P2 to fix the image (fixing step). Residue such as untransferred toner that remains on the circumferential surface of the photosensitive drum 201 after the transferring step is removed by a C blade 207 that is cleaning means (cleaning step). Images are formed by repeating the image forming process (charging, exposing, developing, transferring, fixing, and cleaning steps) described above.

<Developer Amount Detecting Portion of Configuration (a) According to Present Embodiment>

Figure 12:
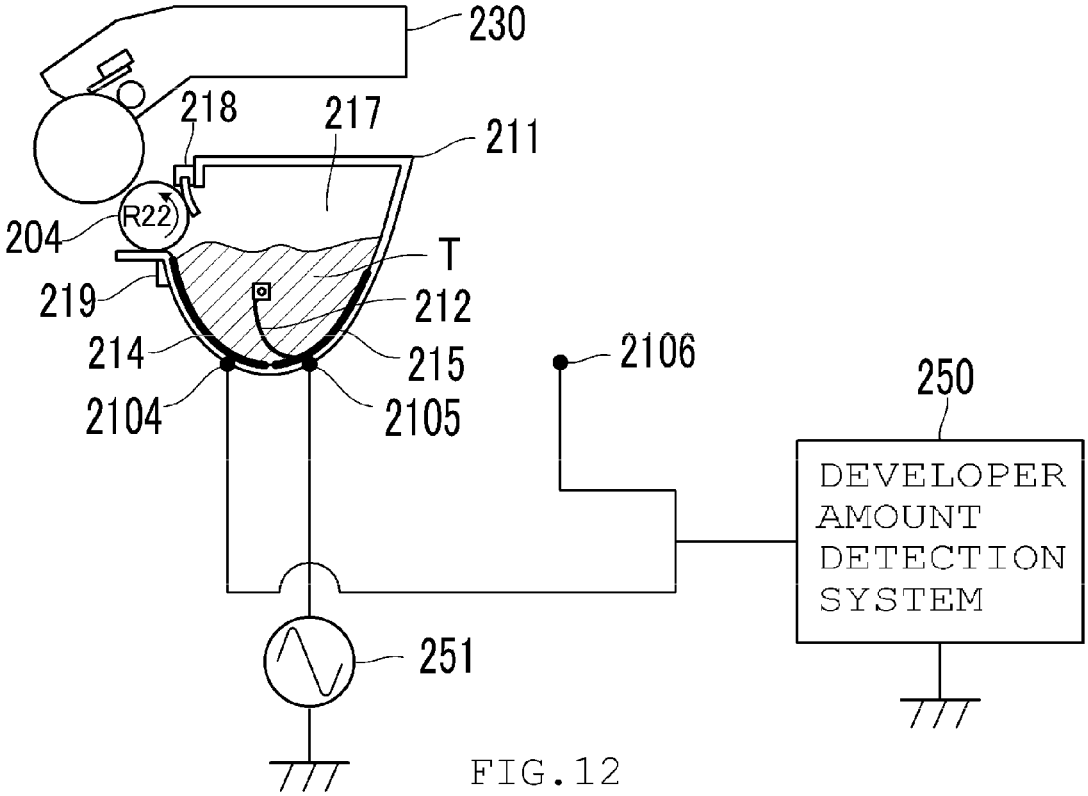
FIG. 12 is a schematic view of a cartridge A2.
Figure 13:
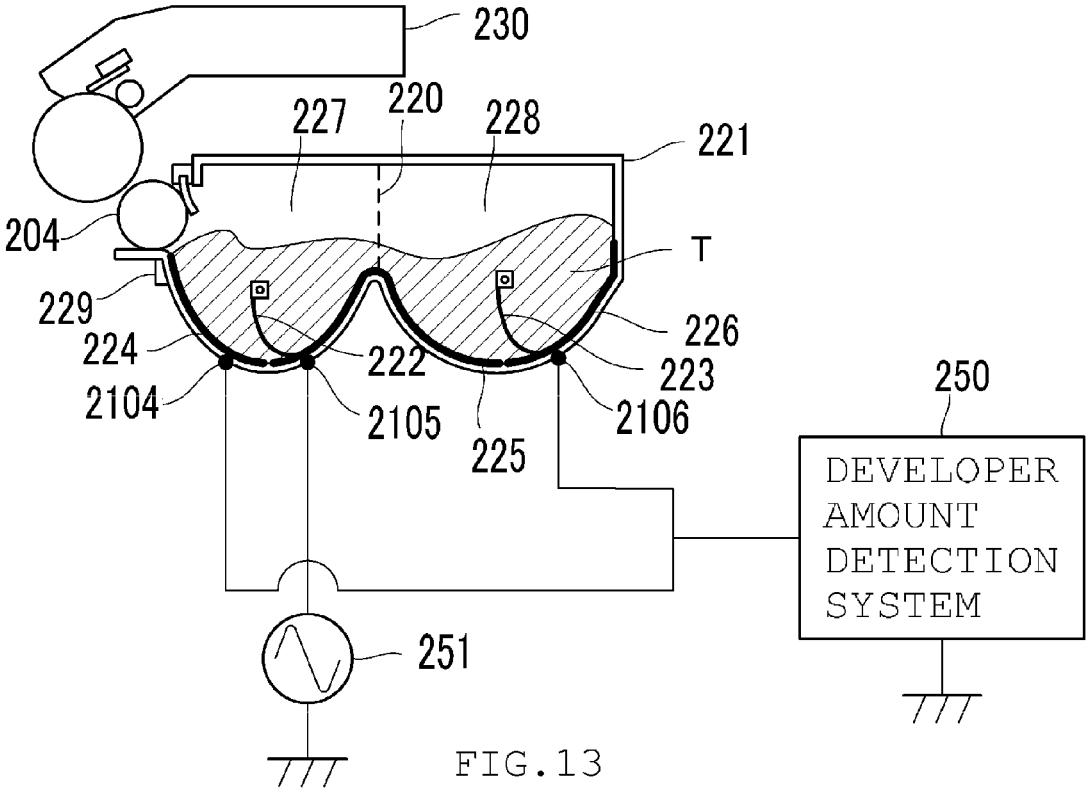
FIG. 13 is a schematic view of a cartridge B2.

FIG. 12 is a schematic view of the cartridge A2. The cartridge A2 according to the present embodiment includes the cleaning apparatus 230 and the developing apparatus 211. The developing sleeve (developing roller) 204 is rotatably arranged in the developing apparatus 211, and the developing apparatus 211 includes a developer housing member (hereinafter, referred to as a toner chamber) 217 that houses the toner T.

The magnetic single component toner T housed in the toner chamber 217 is supplied from the toner chamber 217 to the developing sleeve 204 by the stirring member 212. The supplied toner T is retained on a surface of the developing sleeve 204 by a magnet that is a magnetic body enveloped by the developing sleeve 204. The toner T held on the surface of the developing sleeve 204 comes into contact with a developing blade 218 constituted by an elastic member with a rotation of the developing sleeve 204 in a direction denoted by R22, subjected to triboelectricity impartation and layer thickness restriction by the developing blade 218, and conveyed to a position opposing the photosensitive drum 201.

As developer amount detecting portions, an antenna member 214 (second electrode) and an antenna member 215 (first electrode) which are a pair of electrodes are arranged with an interval therebetween along a container wall surface (bottom surface) of the toner chamber 217 as electrodes for detecting a toner amount. The antenna members 214 and 215 and a gap therebetween are arranged in an order of the antenna member 215, the gap, and the antenna member 214 in a rotating direction of the stirring member 212 which is a direction of movement of the stirring member 212 when a stirring portion is positioned below a stirring shaft (rotary shaft). The stirring portion of the stirring member 212 is configured so that a tip side thereof slides against at least the bottom surface of the toner chamber 217 and also comes into sliding contact with the antenna members 214 and 215 installed on the bottom surface.

In this case, a bottom surface refers to a portion which is a lower wall surface area among areas opposing each other in a vertical direction on a wall surface forming the toner chamber in the frame body of the developer container (an area opposing a ceiling area of the toner chamber) and on which the toner is mounted even if temporarily.

The antenna members 214 and 215 have conductive properties and when the cartridge is mounted to the apparatus main body, the antenna member become electrically conductive with the apparatus main body and are used to detect a developer amount. A contact 2104 (a second terminal) that provides electrical continuity with the antenna member 214 and a contact 2105 (a first terminal) that provides electrical continuity with the antenna member 215 is provided on the apparatus main body 2100. A contact 2106 (a third terminal) that provides electrical continuity with an antenna member 226 of the cartridge B2 (to be described later) is configured as a float. In a state where the cartridge A2 is mounted to the apparatus main body 2100, voltage is input to the antenna member 215 from the apparatus main body 2100 through the contact 2105. The antenna member 214 outputs voltage in accordance with capacitance between the antenna member 214 and the antenna member 215 to the apparatus main body 2100 through the contact 2104. The capacitance is correlated with an amount of developer between the antenna member 214 and the antenna member 215.

In addition, the cartridge B2 according to the present embodiment includes the cleaning apparatus 230 and the developing apparatus 221 in a similar manner to the cartridge A2. The developing sleeve 204 is rotatably arranged in the developing apparatus 221, and the developing apparatus 221 includes toner chambers 227 and 228 housing the toner T and a communication port 220 for supplying toner from the toner chamber 228 (second housing area) to the toner chamber 227 (first housing area). The toner T in the toner chamber 228 is conveyed from the toner chamber 228 to the toner chamber 227 through the communication port 220 by a toner stirrer 223 (second stirring member). The magnetic single component toner T in the toner chamber 227 is conveyed from the toner chamber 227 to the developing sleeve 204 by a toner stirrer 222 (first stirring member).

As a developer amount detecting portion, an antenna member 224 (second electrode), an antenna member 225 (first electrode, third electrode), and an antenna member 226 (fourth electrode) are arranged at intervals along container wall surfaces of the toner chambers 227 and 228. In particular, the antenna member 225 is arranged so as to straddle a container wall surface between the toner chambers 227 and 228. Therefore, a portion of the antenna member 225 arranged in the toner chamber 227 becomes an electrode member (first electrode) used for detection of a toner amount in the toner chamber 227 and a portion of the antenna member 225 arranged in the toner chamber 228 becomes an electrode member (third electrode) used for detection of a toner amount in the toner chamber 228. Due to such a configuration of the antenna member 225, the number of electrode members can be reduced. The antenna members 224 and 225 and a gap therebetween are arranged in an order of the antenna member 225, the gap, and the antenna member 224 in a rotating direction of the toner stirrer 222 which is a direction of movement of the toner stirrer 222 when a stirring portion is positioned below a stirring shaft (rotary shaft). The stirring portion of the toner stirrer 222 is configured so that a tip side thereof slides against at least the bottom surface (first bottom surface) of the toner chamber 227 and also comes into sliding contact with the antenna members 224 and 225 installed on the bottom surface. In addition, the antenna members 224 and 225 and a gap therebetween are arranged in an order of the antenna member 226, the gap, and the antenna member 225 in a rotating direction of the toner stirrer 223 which is a direction of movement of the toner stirrer 223 when a stirring portion is positioned below a stirring shaft (rotary shaft). The stirring portion of the toner stirrer 223 is configured so that a tip side thereof slides against at least the bottom surface (second bottom surface) of the toner chamber 228 and also comes into sliding contact with the antenna members 225 and 225 installed on the bottom surface. The antenna members 224, 225, and 226 have conductive properties and when the cartridge is mounted to the apparatus main body, the antenna members become electrically conductive with the apparatus main body and are used to detect a developer amount. The contact 2104 that provides electrical continuity with the antenna member 224, the contact 2105 that provides electrical continuity with the antenna member 225, and the contact 2106 that provides electrical continuity with the antenna member 226 are provided on the apparatus main body 2100. In a state where the cartridge B2 is mounted to the apparatus main body 2100, voltage is input to the antenna member 225 from the apparatus main body 2100 through the contact 2105. The antenna member 224 outputs voltage in accordance with capacitance between the antenna member 224 and the antenna member 225 to the apparatus main body 2100 through the contact 2104. The capacitance (first capacitance) is correlated with an amount of developer between the antenna member 224 and (a toner chamber 227 side portion of) the antenna member 225. In a similar manner, the antenna member 226 outputs voltage in accordance with capacitance between the antenna member 226 and the antenna member 225 to the apparatus main body 2100 through the contact 2106. The capacitance (second capacitance) is correlated with an amount of developer between the antenna member 226 and (a toner chamber 228 side portion of) the antenna member 225.

As described above the cartridges A2 (FIG. 12) and B2 (FIG. 13) differ from one another in a housing amount of the toner T, capacities (housable capacities) of the developing apparatus and the developer container, the number of stirring members, and the configuration and number of antenna members as a developer amount detecting portion. Other functions and the like are the same between the configurations. The antenna members 214, 215, 224, 225, and 226 need only have conductive properties and, in the present embodiment, are configured such that a conductive sheet is integrated with a container frame body by insert molding. However, this configuration is not restrictive and other conductive members may be used instead. For example, a conductive sheet in which a resin is imparted with conductive properties may be used. In this case, since the shape of a sheet can be readily changed during molding and the like, various shapes can be accommodated. In addition, in the present embodiment, the antenna members 214, 215, 224, 225, and 226 are configured to be exposed on the bottom surface and are in a contacting positional relationship with the respective stirring members. However, this configuration is not restrictive and, alternatively, a configuration may be adopted in which the antenna members are embedded inside a frame body constituting the bottom surface. In addition, a configuration may be adopted in which the antenna members are glued to a frame body constituting the housing chamber from the outside.

As described above, the apparatus main body 2100 of the image forming apparatus according to the present embodiment is configured such that a plurality of types of cartridges A2 (FIG. 12) and B2 (FIG. 13) with different numbers of antenna members (electrodes) can be attached/detached to/from the apparatus main body 2100. Furthermore, contacts (terminals) for electrically connecting the antenna members and the apparatus main body 2100 to each other when the cartridges A2 and B2 are mounted to the apparatus main body 2100 are provided in the same number as a largest number between the numbers of electrodes respectively included in the cartridges A2 and B2. With the configuration according to the present embodiment, detection of a remaining toner amount can be performed at high accuracy regardless of types of the plurality of cartridges with different developer housing amounts. Moreover, the contacts (terminals) may be provided in the same number as or a larger number than the largest number between the number of electrodes respectively included in the cartridges A2 and B2.

A configuration to which the present invention can be applied is not limited to the configuration according to the present embodiment and the present invention can be applied to configurations in which any of the number or shape of the developer amount detecting portion, the number of voltage input, the number of voltage output, and the like or a combination thereof is different. For example, the present invention can even be applied to a configuration in which the developing sleeve 204 functions as an electrode for detecting a developer amount in a housing chamber.

<Cartridge Identifying Member>

As described above, when the cartridges A2 (FIG. 12) and B2 (FIG. 13) are mounted to the apparatus main body 2100, a predetermined mounted state is created where the cartridges A2 and B2 are mechanically and electrically coupled to the apparatus main body 2100. Accordingly, a cartridge-side driven member enters a state where the cartridge-side driven member can be driven by an apparatus main body-side driving mechanism. In addition, a bias can be applied to necessary members of the cartridge from a power supply of the apparatus main body. Furthermore, sensors and storage media of the cartridge become electrically continuous with a control member of the apparatus main body.

A control member (controller) provided on the apparatus main body 2100 of the image forming apparatus is constituted by a microcomputer (control means 255) made up of a memory (storage member) such as a ROM or a RAM and a CPU, various input/output control circuits, and the like.

In this case, information that identifies a cartridge type is respectively stored in storage media 219 and 229 that are microchips or the like provided in the cartridges A2 and B2. The control member of the apparatus main body 2100 provides electrical continuity with the storage medium 219 or the storage medium 229, acquires information related to a developer housing amount stored in the storage medium 219 or the storage medium 229, and distinguishes between the cartridge A2 and the cartridge B2 (distinguishing portion). A distinguished result is stored in a memory and used in a developer amount detection system 250 when calculating a remaining developer amount according to the type of the cartridge.

As described above, in the present embodiment, a type of a cartridge is distinguished based on information related to a developer housing amount stored in a storage medium attached to the cartridge. However, other configurations may be adopted as long as a type of a cartridge can be distinguished at the apparatus main body. Examples include any of a distinguishing method based on a difference in container shapes, a distinguishing method based on a difference in configurations of or numbers of a developer amount detecting portions (for example, a distinguishing method based on a difference in capacitance or whether or not electrical continuity is provided), and the like or a combination of these methods.

<Developer Amount Detection System>

The apparatus main body 2100 determines a type of a mounted cartridge using a cartridge identifying member and, as a result, changes the number of output values, a threshold, and a computing method of the developer amount detecting portion.

Figure 14:
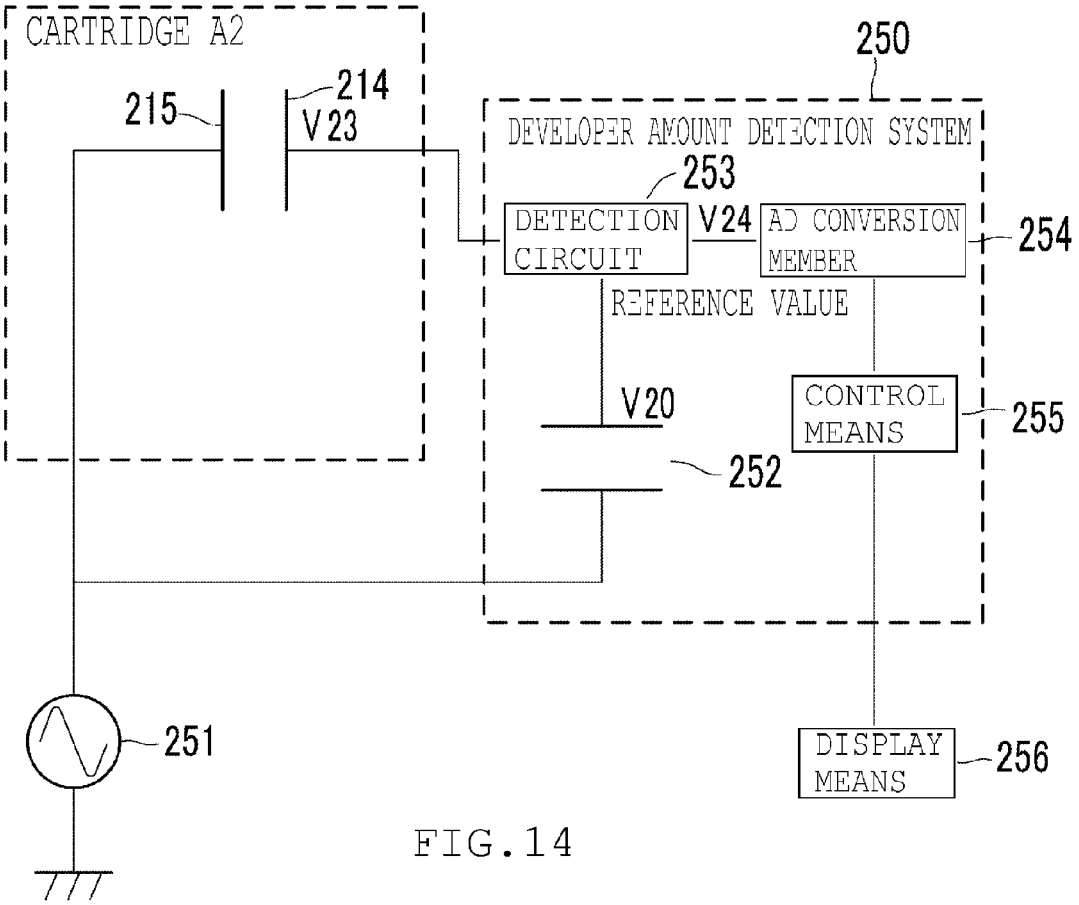
FIG. 14 is a circuit configuration diagram of a developer amount detection system in the cartridge A2 according to the third embodiment.

FIG. 14 is a circuit configuration diagram of the developer amount detection system 250 in a case where the cartridge A2 (FIG. 12) is mounted to the apparatus main body 2100. When a predetermined AC bias is output from an AC power supply 251 as bias applying means (applying portion) provided on the apparatus main body 2100, the AC bias is applied to a reference capacitor 252 and to the antenna member 215 of the cartridge A2 through the contact 2105. Accordingly, a voltage V20 is generated on the reference capacitor 252, while a voltage V23 is generated on the antenna member 214 accompanying a current corresponding to capacitance between the antenna members 214 and 215 and output to a detection circuit 253 (detecting portion) through the contact 2104. The detection circuit 253 generates a voltage V24 from a voltage difference between V20 and V23 and outputs the voltage V24 to an AD conversion portion 254. The AD conversion portion 254 outputs a result V24A of computation and digital conversion of the analog voltage V24 to the control means 255. The control means 255 determines a level of a developer amount using this result and a result of a cartridge type determined by the cartridge identifying member (acquiring portion). Display means (informing means) 256 such as a display panel provided on the apparatus main body 2100 informs the user of the developer amount level determined by the control means 255.

Figure 15:
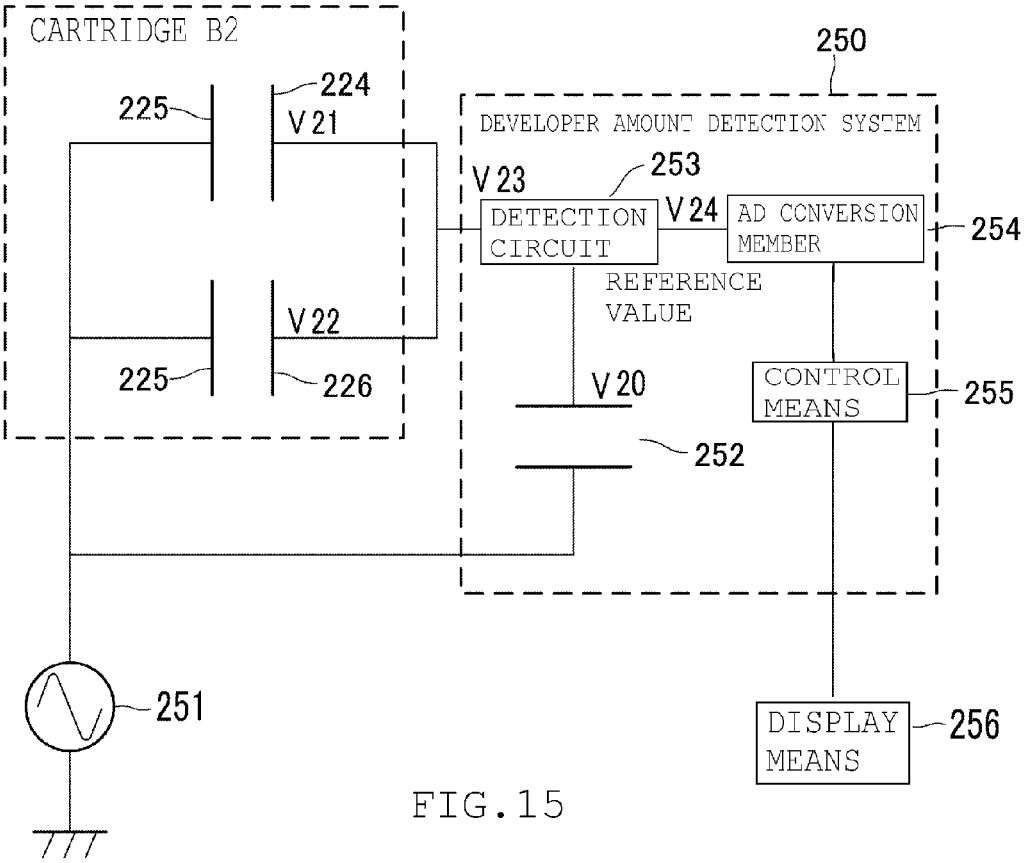
FIG. 15 is a circuit configuration diagram of a developer amount detection system in the cartridge B2 according to the third embodiment.

FIG. 15 is a circuit configuration diagram of the developer amount detection system 250 in a case where the cartridge B2 (FIG. 13) is mounted to the apparatus main body 2100. When a predetermined AC bias is output from an AC power supply 251 provided on the apparatus main body 2100, the AC bias is respectively applied to a reference capacitor 252 and to the antenna member 225 of the cartridge B2 through the contact 2105. Accordingly, a voltage V20 is generated on the reference capacitor 252, while a voltage V21 and a voltage V22 are respectively generated on the antenna members 224 and 226 accompanying currents corresponding to capacitance between the antenna members 224, 226 and the antenna member 225. V21 and V22 are combined on the side of the apparatus main body 2100 through the contacts 2104 and 1206 and output as V23 that is combined voltage to the detection circuit 253. The detection circuit 253 generates a voltage V24 from a voltage difference between V20 and V23 and outputs the voltage V24 to the AD conversion portion 254. The AD conversion portion 254 outputs a result V24B of computation and digital conversion of the analog voltage V24 to the control means 255. The control means 255 determines a level of a developer amount using this result and a result of a cartridge type determined by the cartridge identifying member. The display means 256 informs the user of a developer amount level determined by the control means 255.

<Developer Amount Detecting Method>

In the present embodiment, the cartridge A2 and the cartridge B2 can be mounted to the apparatus main body 2100. Cartridge identifying members are respectively annexed to the cartridges A2 and B2, and when the cartridge A2 or the cartridge B2 is mounted, the apparatus main body 2100 provides electrical continuity with the cartridge identifying members to distinguish between the cartridges A2 and B2. In addition, the cartridge A2 and the cartridge B2 differ from each other in configurations of developer amount detecting portions and when mounted to the apparatus main body 2100, the cartridges A2 and B2 have different circuit configurations as developer amount detection systems as shown in FIGS. 14 and 15 and perform a developer amount detecting operation with the respective circuit configurations.

Figure 10:
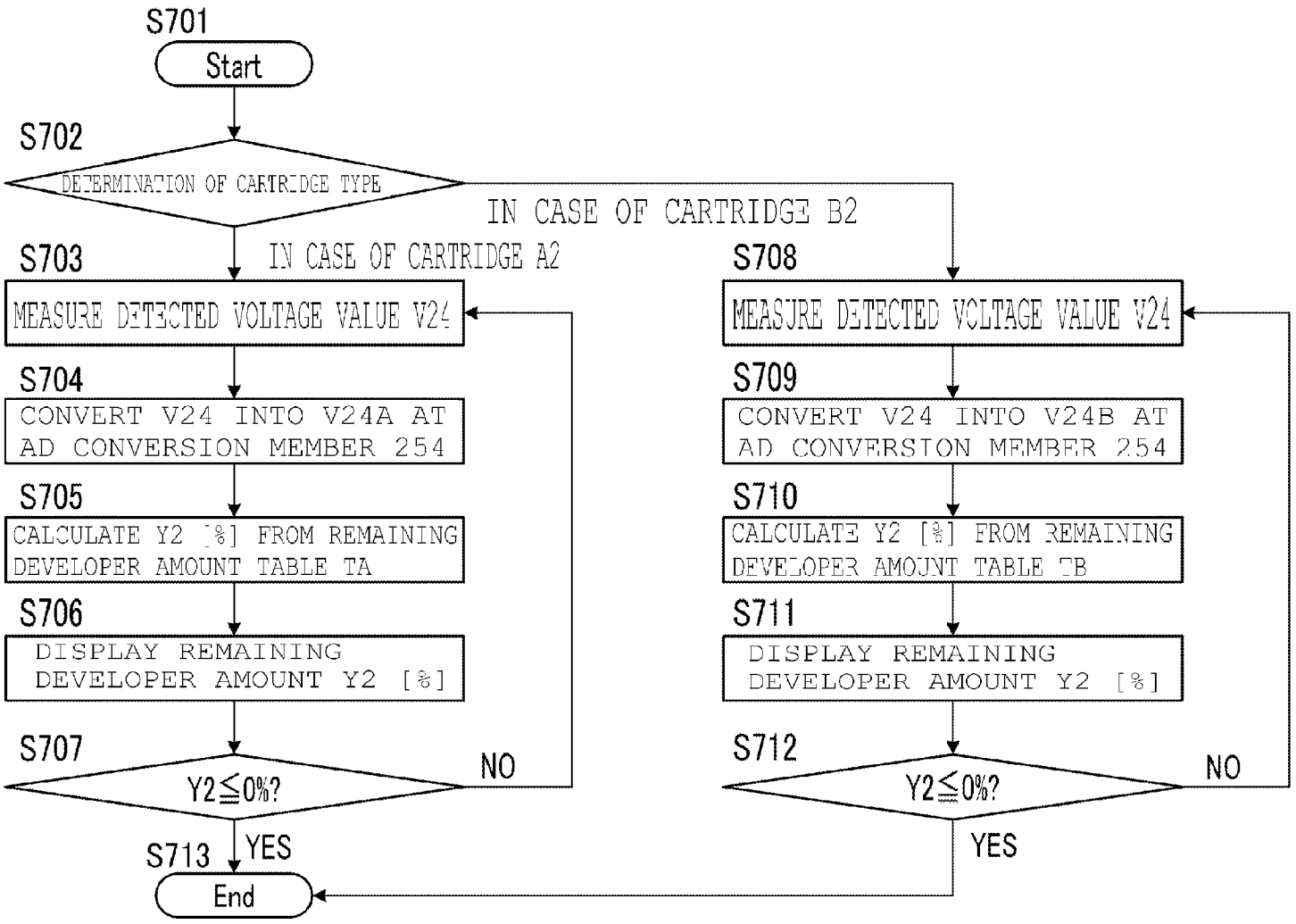
FIG. 10 is a sequence diagram of a developer amount detecting method according to a third embodiment.

FIG. 10 is a flow chart of a developer amount detecting operation after the cartridge A2 (FIG. 12) or the cartridge B2 (FIG. 13) is mounted to the apparatus main body 2100. The developer amount detecting method will be described in detail with reference to the flow chart in FIG. 10.

S701: Mount a cartridge to the apparatus main body.

S702: Determine the type of the cartridge using the cartridge identifying member, and advance to S703 when the cartridge is determined to be the cartridge A2 and advance to S708 when the cartridge is determined to be the cartridge B2.

(When Determined to be Cartridge A2 (First Cartridge))

S703: Measure detection voltage V24 through the detection circuit 253.

S704: Compute and digitally-convert V24 using the A/D conversion member 254 to generate V24A. At this point, a method of computing V24 by the A/D conversion member 254 differs between the cartridges A2 and B2.

S705: Collate a value of V24A with a remaining developer amount table TA (a table including a correspondence relationship between detected voltage values and developer amounts) stored in advance in a memory and convert the value of V24A into a remaining developer amount Y2 [%]. In this case, the remaining developer amount table TA refers to a table for the cartridge A2 which provides V24A with a threshold and associates the remaining developer amount Y2 [%] and V24A with each other so that Y2 [%] is converted in 1% increments. This threshold differs between the cartridge A2 and the cartridge B2.

S706: Display Y2 [%] on the display means 256.

S707: Check whether or not remaining developer amount Y2 [%] has reached 0%. Advance to S703 when a determination of "NO" is made and advance to S713 when a determination of "YES" is made.

(When determined to be cartridge B2 (second cartridge))

S708: Measure detection voltage V24 through the detection circuit 253.

S709: Compute and digitally-convert V24 using the A/D conversion member 254 to generate V24B. At this point, a method of computing V24 by the A/D conversion member 254 differs between the cartridges A2 and B2.

S710: Collate a value of V24B with a remaining developer amount table TB stored in advance in a memory and convert the value of V24B into a remaining developer amount Y2 [%]. In this case, the remaining developer amount table TB refers to a table for the cartridge B2 which provides V24B with a threshold and associates the remaining developer amount Y2 [%] and V24B with each other so that Y2 [%] is converted in 1% increments. This threshold differs between the cartridge A2 and the cartridge B2.

S711: Display Y2 [%] on the display means 256.

S712: Check whether or not remaining developer amount Y2 [%] has reached 0%. Advance to S708 when a determination of "NO" is made and advance to S713 when a determination of "YES" is made.

S713: End developer amount detection.

As described above, while both a computing method and a threshold in a developer amount detecting operation are changed depending on the type of cartridge in the present embodiment, the present invention is not limited thereto and other configurations which change either the computing method or the threshold or a combination thereof may be adopted.

Fourth Embodiment

In the third embodiment, in a developer amount detection system, developer amount detection is performed by inputting a voltage V23 that combines a voltage V21 generated at the antenna member 224 and a voltage V21 generated at the antenna member 226 in the cartridge B2 to the detection circuit 253.

A fourth embodiment of the present invention is configured to perform developer amount detection without combining voltages V21 and V22 respectively generated at the antenna members 224 and 225. Specifically, in accordance with a remaining developer amount, any of the voltages V21 and V22 to be input to the detection circuit 253 is selected and used to detect a remaining developer amount.

Hereinafter, descriptions of sections that overlap with the third embodiment will be omitted and feature portions of the fourth embodiment will be mainly described. It is to be understood that matters not described here are similar to those described in the third embodiment.

<Developer Amount Detection System of Configuration (a) According to Present Embodiment>

Figure 16:
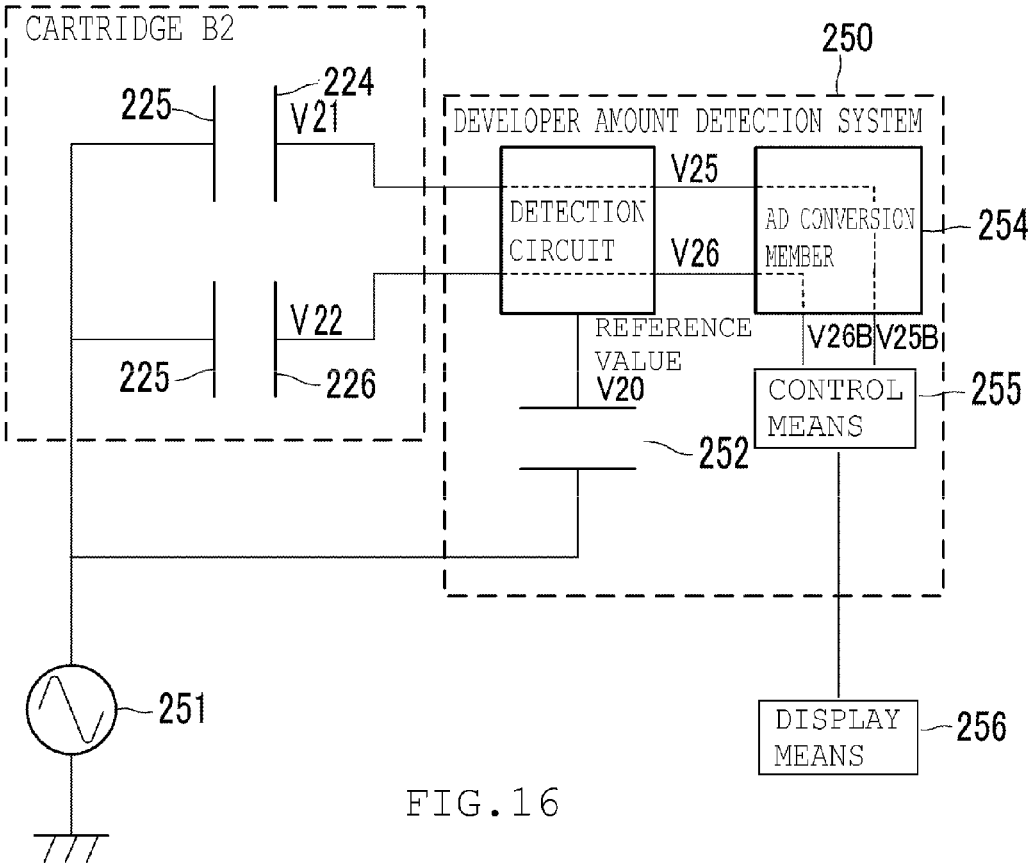
FIG. 16 is a circuit configuration diagram of a developer amount detection system in the cartridge B2 according to a fourth embodiment.

FIG. 16 is a circuit configuration diagram of the developer amount detection system 250 in a case where the cartridge B2 (FIG. 13) is mounted to the apparatus main body 2100. When a predetermined AC bias is output from an AC power supply 251 provided on the apparatus main body 2100, the AC bias is respectively applied to a reference capacitor 252 and to the antenna member 225 of the cartridge B2 through the contact 2105. Accordingly, a voltage V20 is generated on the reference capacitor 252, while a voltage V21 and a voltage V22 are respectively generated on the antenna members 224 and 226 accompanying currents corresponding to capacitance between the antenna members 224, 226 and the antenna member 225. V21 (first voltage value) and V22 (second voltage value) are separately output to the detection circuit 253, V21 being output through the contact 2104 and V22 being output through the contact 2106. The detection circuit 253 generates a voltage V25 that is a potential difference between V21 and V20 and a voltage V26 that is a potential difference between V22 and V20, and outputs V25 and V26 to the A/D conversion member 254. The A/D conversion member 254 outputs respective results V25B and V26B of digital conversion of the analog voltages V25 and V26 to the control means 255. The control means 255 selects either V25B or V26B depending on the remaining developer amount and determines a developer amount level using a result of a cartridge type determined by the cartridge identifying member. The display means 256 informs the user of a developer amount level determined by the control means 255.

<Developer Amount Detecting Method>

Figure 17:
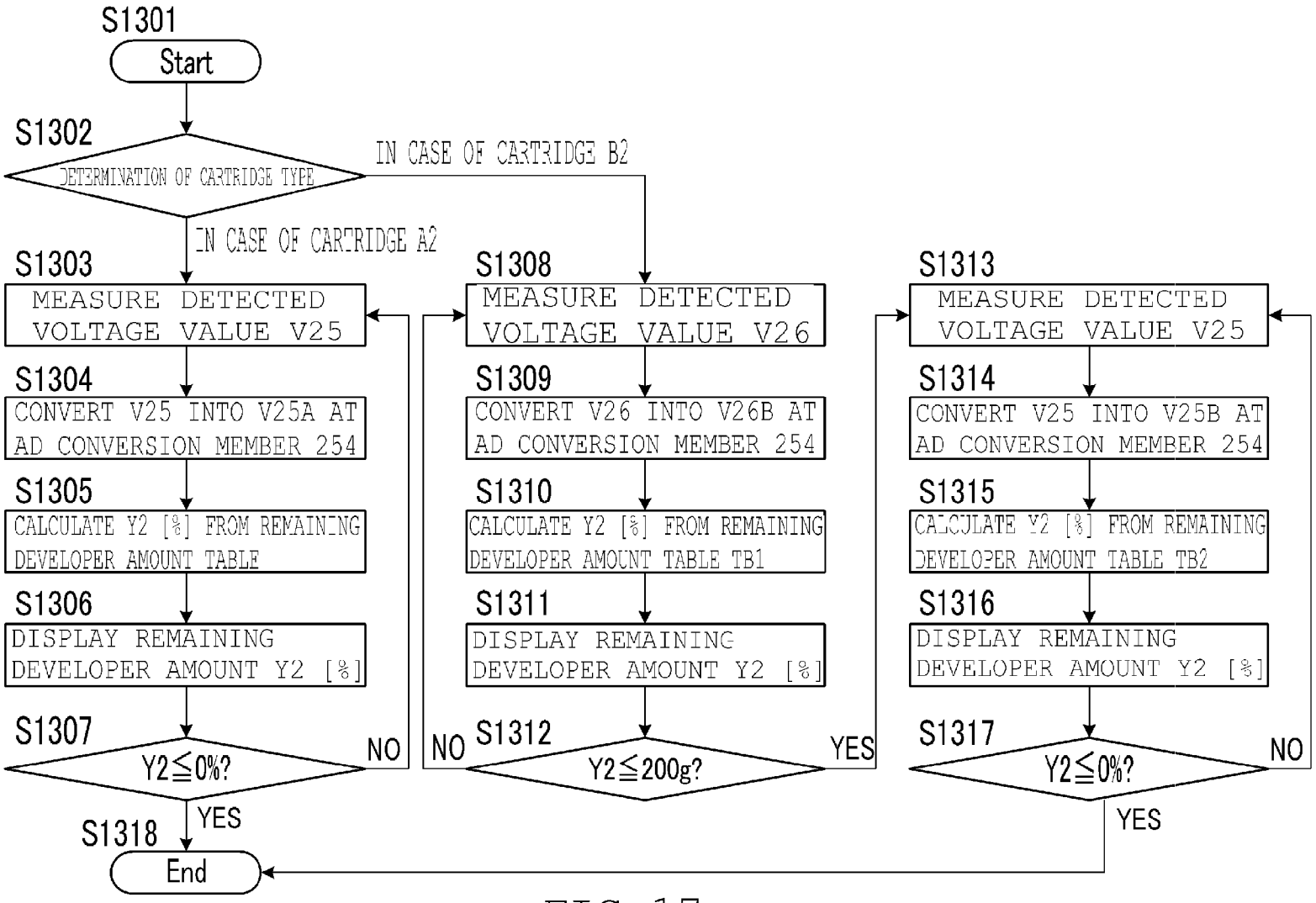
FIG. 17 is a sequence diagram of a developer amount detecting method according to the fourth embodiment.

FIG. 17 is a flow chart of a developer amount detecting operation after the cartridge A2 (FIG. 12) or B2 (FIG. 13) is mounted to the apparatus main body 2100. The developer amount detecting method will be described in detail with reference to the flow chart in FIG. 17.

S1301: Mount a cartridge to the apparatus main body.

S1302: Determine the type of the cartridge using the cartridge identifying member, and advance to S1303 when the cartridge is determined to be the cartridge A2 and advance to S1308 when the cartridge is determined to be the cartridge B2.

(When Determined to be Cartridge A2)

S1303: Measure detection voltage V25 through the detection circuit 253.

S1304: Compute and digitally-convert V25 using the A/D conversion member 254 to generate V25A. At this point, a method of computing V25 by the A/D conversion member 254 differs between the cartridges A2 and B2.

S1305: Collate a value of V25A with a remaining developer amount table TA1 stored in advance in a memory and convert the value of V25A into a remaining developer amount Y2 [%]. In this case, the remaining developer amount table TA1 refers to a table for the cartridge A2 which provides V25A with a threshold and associates the remaining developer amount Y2 [%] and V25A with each other so that Y2 [%] is converted in 1% increments. This threshold differs between the cartridge A2 and the cartridge B2.

S1306: Display Y2 [%] on the display means 256.

S1307: Check whether or not remaining developer amount Y2 [%] has reached 0%. Advance to S1303 when a determination of "NO" is made and advance to S1318 when a determination of "YES" is made.

(When Determined to be Cartridge B2)

S1308: Measure detection voltage V26 through the detection circuit 253.

S1309: Compute and digitally-convert V26 using the A/D conversion member 254 to generate V26B.

S1310: Collate a value of V26B with a remaining developer amount table TB1 (second table) stored in advance in a memory and convert the value of V26B into a remaining developer amount Y2 [%]. In this case, the remaining developer amount table TB1 refers to a table for the cartridge B2 (for detection of a remaining developer amount in the toner chamber 228) which provides V26B with a threshold and associates the remaining developer amount Y2 [%] and V26B with each other so that Y2 [%] is converted in 1% increments. This threshold differs between the cartridge A2 and the cartridge B2.

S1311: Display Y2 [%] on the display means 256.

S1312: Check whether or not the remaining developer amount Y2 [%] has reached a value corresponding to 200 g (whether or not an amount of the developer has equaled or fallen below a predetermined threshold). Advance to S1308 when a determination of "NO" is made and advance to S1313 when a determination of "YES" is made.

S1313: Measure detection voltage V25 through the detection circuit 253.

S1314: Compute and digitally-convert V25 using the A/D conversion member 254 to generate V25B. At this point, a method of computing V25 by the A/D conversion member 254 differs between the cartridges A2 and B2.

S1315: Collate a value of V25B with a remaining developer amount table TB2 (first table) stored in advance in a memory and convert the value of V25B into a remaining developer amount Y2 [%]. In this case, the remaining developer amount table TB2 refers to a table for the cartridge B2 (for detection of a remaining developer amount in the toner chamber 227) which provides V25B with a threshold and associates the remaining developer amount Y2 [%] and V25B with each other so that Y2 [%] is converted in 1% increments. Moreover, the same threshold may be used for the cartridge A2 and the cartridge B2 and the remaining developer amount table TA1 may be used as the remaining developer amount table TB2.

S1316: Display Y2 [%] on the display means 256.

S1317: Check whether or not remaining developer amount Y2 [%] has reached 0%. Advance to S1313 when a determination of "NO" is made and advance to S1318 when a determination of "YES" is made.

S1318: End developer amount detection.

As described above, while both a computing method and a threshold in a developer amount detecting operation are changed depending on the type of cartridge in the present embodiment, the present invention is not limited thereto and other configurations which change either the computing method or the threshold or a combination thereof may be adopted.

Figure 18:
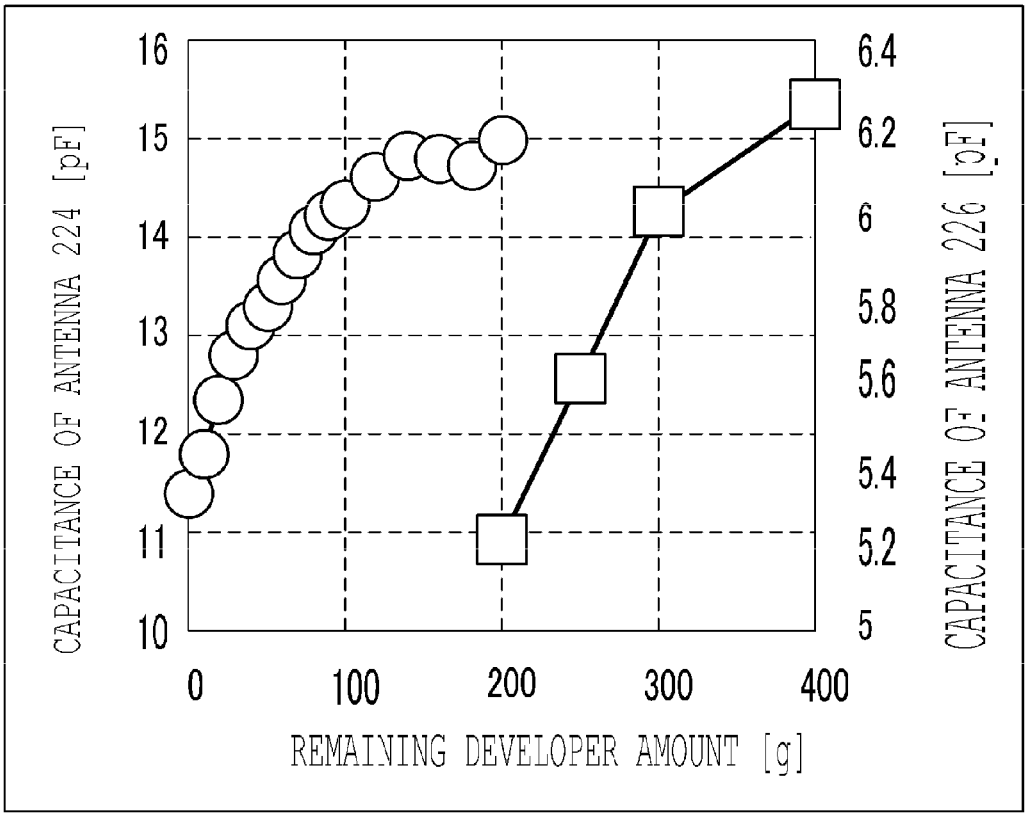
FIG. 18 is a relationship diagram between developer amount and capacitance in the cartridge B2 according to the fourth embodiment.

FIG. 18 is a graph representing a relationship between developer amount and capacitance of a developer amount detecting portion in the cartridge B2 (FIG. 13) according to the fourth embodiment. However, errors occur in absolute values of capacitance in the graph due to measurement environment or the like. In this case, the measurement environment or the like may be fixed and the absolute values may be used for remaining amount detection. In FIG. 18, —□— depicts a relationship between a remaining developer amount and capacitance of the antenna member 226 (fourth electrode) (capacitance between the antenna member 226 (fourth electrode) and a portion of the antenna member 225 on the side of the toner chamber 228 (third electrode). In addition, in FIG. 18, —○— depicts a relationship between a remaining developer amount and capacitance of the antenna member 224 (second electrode) (capacitance between the antenna member 224 (second electrode) and a portion of the antenna member 225 on the side of the toner chamber 227 (first electrode). When the remaining developer amount ranges from 200 to 400 g, a change in capacitance of the antenna member 226 can be confirmed, and when the remaining developer amount ranges from 0 to 200 g, a change in capacitance of the antenna member 224 can be confirmed. Therefore, by varying the change in capacitance used when the remaining developer amount is 200 g, a developer amount can be detected over the entire range of 0 to 400 g.

Fifth Embodiment

The fifth embodiment according to the present invention will now be described.

Figure 19:
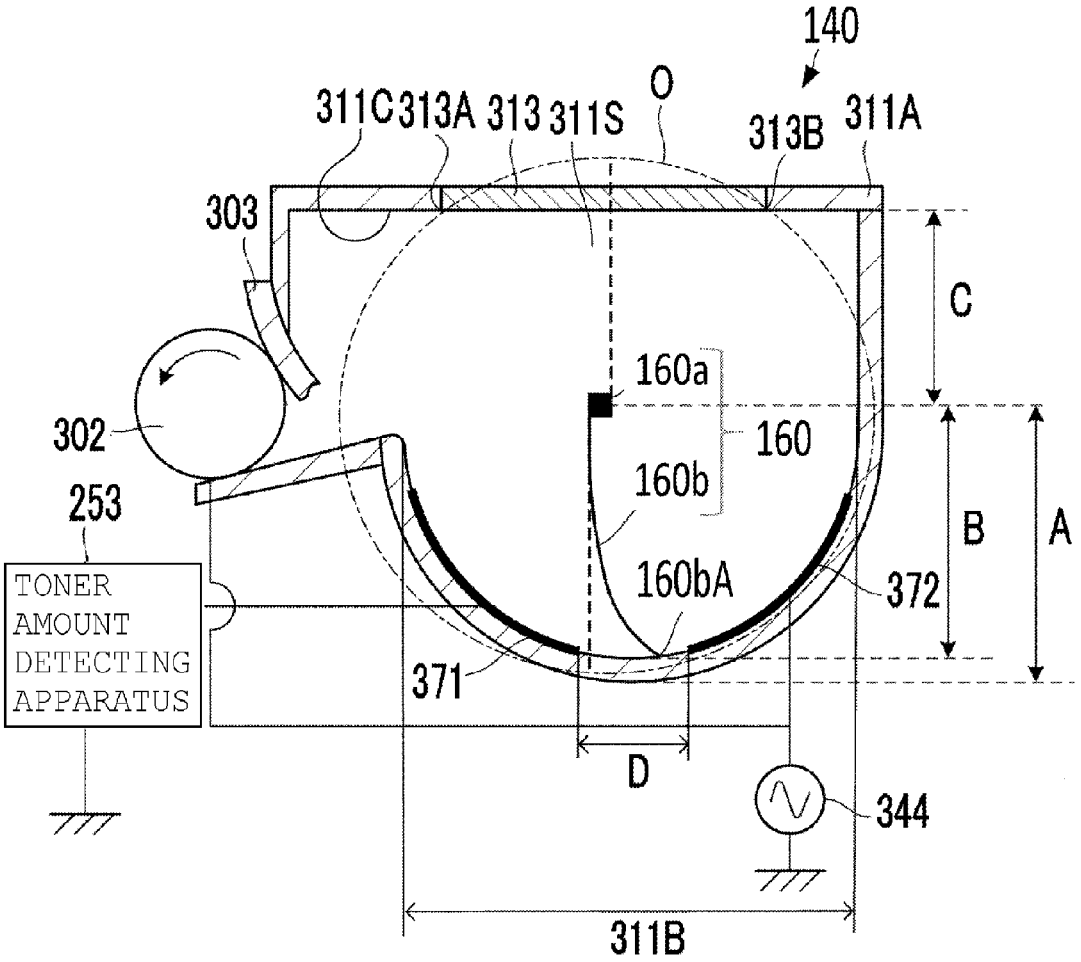
FIG. 19 is a schematic view of a developing apparatus according to a fifth embodiment.

Developer amount detecting means according to the fifth embodiment will be described with reference to FIG. 19. FIG. 19 is a schematic view of a developing apparatus according to the present embodiment. A diagram of a circuit for detecting a developer amount in a developer container shown in FIG. 19 is similar to that in FIG. 4 and therefore will be omitted. A relationship between an amount of developer housed in the developer container and detected combined capacitance is similar to that in FIG. 7 and therefore will be omitted. In this case, the combined capacitance refers to capacitance that combines capacitance (inter-electrode capacitance) between an antenna member 371 (first electrode) and an antenna member 372 (second electrode) and capacitance between a developing roller 302 and the antenna member 371. The fifth embodiment uses developer amount detecting means that uses a change in capacitance as means for detecting an amount of developer housed in a developer container 311A. Moreover, the antenna member 371 and the antenna member 372 constitute a detecting portion for detecting a developer amount.

As shown in FIG. 19, the antenna member 371 is provided on a bottom surface 311B in the developer container 311A and the antenna member 372 is provided on the bottom surface 311B at an interval D from the antenna member 371. In addition, the antenna member 371 and the antenna member 372 are arranged so as to oppose each other along the bottom surface 311B in the developer container 311A. Moreover, although the antenna member 371 and the antenna member 372 form a conductive sheet in the fifth embodiment, a configuration of the antenna member 371 and the antenna member 372 is not limited as long as a material having conductive properties is used. In this case, the bottom surface 311B refers to a port ion which is a lower wall surface area among areas opposing each other in a vertical direction on a wall surface forming a housing chamber 311S in the developer container 311A (an area opposing a ceiling surface 311C of the housing chamber 311S) and on which the toner is mounted even if temporarily.

In this case, using an area S of the antenna member 371 (the antenna member 372), a distance d3 between the antenna member 371 and the antenna member 372, and specific dielectric constant K∈, capacitance C3 between the antenna member 371 and the antenna member 372 may be expressed as follows.

$$C3=K\in\times S/d3 \quad (2)$$

The specific dielectric constant K∈ in Expression (2) changes depending on the developer amount between the antenna member 371 and the antenna member 372. When the developer amount between the antenna member 371 and the antenna member 372 is large, the specific dielectric constant K∈ increases and the capacitance C3 also increases. In addition, when the developer amount between the antenna member 371 and the antenna member 372 is small, the specific dielectric constant K∈ decreases and the capacitance C3 also decreases. Using this relationship, a developer amount in the developer container 311A can be detected based on a change in combined capacitance that combines capacitance between the antenna member 371 and the antenna member 372 and capacitance between the developing roller 302 and the antenna member 371.

Next, a configuration for extending a period of time during which developer is positioned between the antenna member 371 and the antenna member 372 will be described with reference to FIG. 19. In the present embodiment, the developer container 311A includes the housing chamber 311S, the antenna member 371, the antenna member 372, the stirring member 160, and a contact portion 313. As described earlier, the developing roller 302 bears the developer and supplies the developer to the photosensitive drum 120. Developer for developing an electrostatic latent image is housed in the housing chamber 311S. In addition, by rotating around a stirring shaft 160*a*, the stirring member 160 stirs the developer housed in the housing chamber 311S and supplies the developer to the developing roller 302.

Figure 26A:
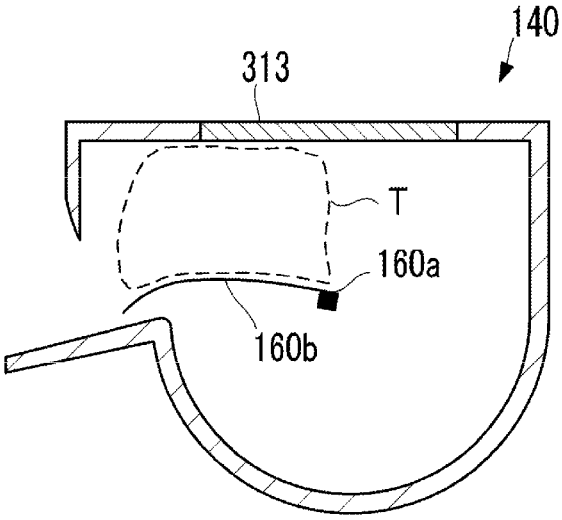
FIGS. 26A to 26C are diagrams showing spaces on a stirring member on which developer can be loaded.
Figure 26B:
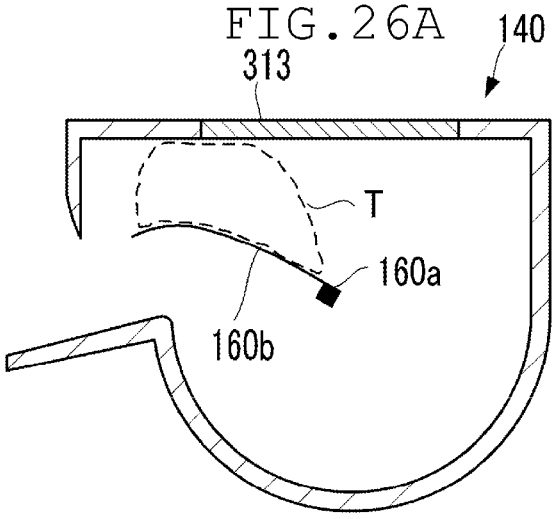
Figure 26C:
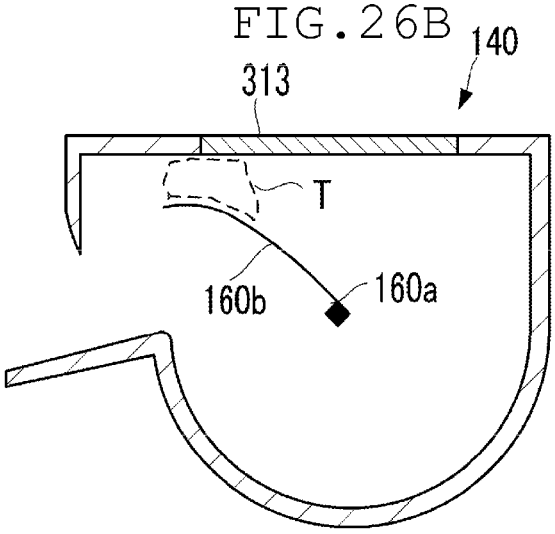

In this case, a part of the ceiling surface 311C of the developer container 311A in the housing chamber 311S constitutes the contact portion 313 which is capable of coming into contact with a stirring portion 160*b* of the rotating stirring member 160. When the stirring member 160 rotates, the stirring portion 160*b* comes into contact with the contact portion 313 and the contact portion 313 pushes off the developer on the stirring portion 160*b* so that the developer drops to the bottom surface 311B at a faster rate than when dropping from the stirring portion 160*b* by its own weight. In other words, the contact portion 313 comes into contact with the stirring member 160 so as to gradually narrow a space on the stirring member 160 on which the developer can be loaded. As shown in FIGS. 26A to 26C, the space on the stirring member 160 on which the developer can be loaded is gradually narrowed with the rotation of the stirring member 160 (FIG. 26A→FIG. 26B→FIG. 26C). An amount of toner loaded on the stirring member 160 decreases quickly as compared to a case where the contact portion 313 is not provided. In addition, the contact portion 313 comes into contact with the developer on the stirring member 160 at a position above the stirring shaft 160*a* of the stirring member 160.

As described earlier, the antenna member 371 and the antenna member 372 are provided on the bottom surface 311B. In the fifth embodiment, the bottom surface 311B constitutes a depressed port ion and the interval D provided between the antenna member 371 and the antenna member 372 is positioned at a lowermost portion of the depressed portion or in a vicinity thereof. Accordingly, the developer having dropped from the stirring portion 160*b* gathers in the interval D provided between the antenna member 371 and the antenna member 372. Moreover, while apart of the ceiling surface 311C of the developer container 311A constitutes the contact portion 313 in the present embodiment, the contact portion 313 may be provided as a separate member from the ceiling surface 311C. However, the contact portion 313 is not limited to the ceiling surface and may have a shape of a convex portion that protrudes toward a bottom portion. The contact portion is provided for causing developer to efficiently drop to the gap in the bottom portion. A relationship between a length of the contact portion and the interval D is favorably expressed as 2×interval D≤contact portion≤4×interval D and more favorably expressed as 2×interval D≤contact portion≤3×interval D.

Next, a positional relationship among the stirring member 160, the bottom surface 311B, and the contact portion 313 will be described. In FIG. 19, a length A represents a length from a rotational axis of the stirring member 160 to a tip 160*b*A of the stirring portion 160*b* and a distance B represents a distance in a vertical direction between the rotational axis of the stirring member 160 to the bottom surface 311B of the housing chamber 311S. In addition, a distance C represents a shortest distance from the rotational axis of the stirring member 160 to the contact portion 313. In the present embodiment, the length A is set equal to or longer than the distance B so that developer loaded on the bottom surface 311B is conveyed by the stirring portion 160*b* to the developing roller 302. In addition, the length A is set longer than the distance C so that the stirring portion 160*b* of the rotating stirring member 160 abuts the contact portion 313. To enable the stirring member 160 to come into contact with the contact portion 313 via the developer and efficiently drop the developer to the bottom portion, the distance A, and the distance C are favorably arranged in a relationship expressed as ⅓ distance A≤distance C≤⅔ distance A.

In the present embodiment, a position where contact between the stirring portion 160*b* of the stirring member 160 and the contact portion 313 starts is above the antenna member 371 and the antenna member 372 in a vertical direction. In addition, as shown in FIG. 19, this position is directly above the antenna member 371 in the vertical direction. Furthermore, a position where the contact between the stirring portion 160*b* and the contact portion 313 ends is also above the antenna member 371 and the antenna member 372 in the vertical direction. In addition, as shown in FIG. 19, this position is directly above the antenna member 372 in the vertical direction. In this manner, by setting the positional relationship among the stirring member 160, the bottom surface 311B, and the contact portion 313 to the relationship described above, the developer on the stirring portion 160*b* can be caused to drop the bottom surface 311B at a faster rate than when dropping by its own weight.

Figure 20:
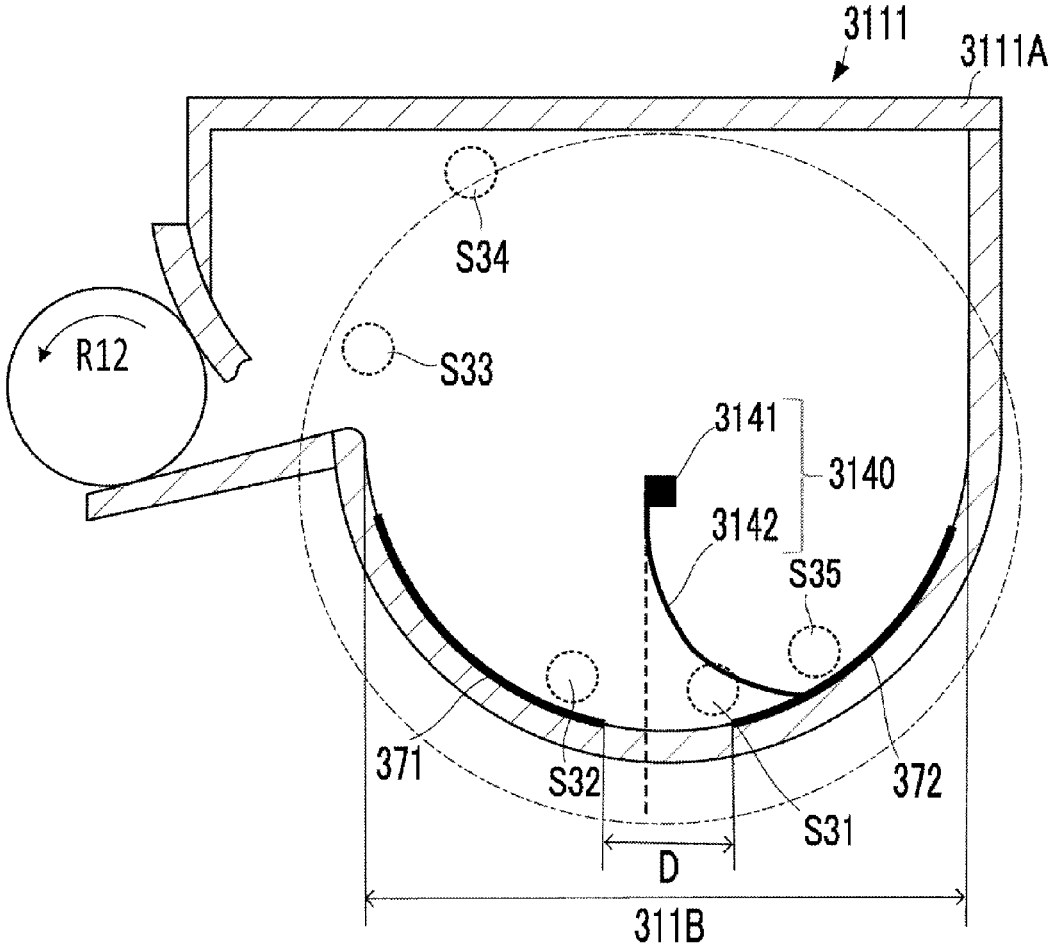
FIG. 20 is a schematic view of a developing apparatus according to a comparative example.
Figure 21:
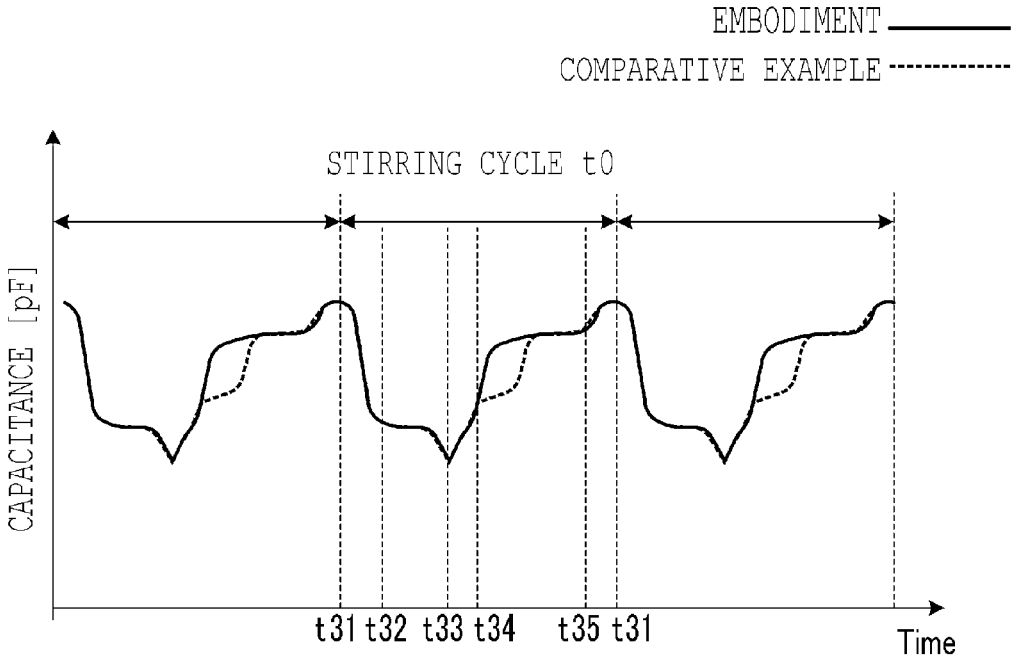
FIG. 21 is a diagram showing a change in combined capacitance due to rotation of a stirring member.

Next, a relationship between a rotational movement of the stirring member 160 and a detected developer amount will be described. Since the developing apparatus according to the present embodiment is similar to that of the first embodiment, FIG. 6 will be used as a schematic view of the developing apparatus according to the present embodiment. In addition, FIG. 20 is a schematic view of a developing apparatus according to a comparative example. In the developing apparatus 140 according to the present embodiment, as described earlier, the length A is equal to or longer than the distance B and longer than the distance C. On the other hand, in a developing apparatus 3111 according to the comparative example, the length A is equal to or longer than the distance B and shorter than the distance C. FIG. 21 is a diagram showing a change in combined capacitance when an amount of developer housed in the housing chamber is 40 g. In FIG. 21 a change in combined capacitance according to the present embodiment is depicted by a solid line and a combined capacitance according to the comparative example is depicted by a dotted line. t31 to t35 in FIG. 21 respectively represent timings where a change had occurred in the combined capacitance.

A change in combined capacitance caused by rotation of the stirring member 160 will be described with reference to FIGS. 6, 19, 20, and 21. In this case, the 40 g of developer inside the housing chamber 311S may be divided into developer that moves and developer that does not move due to rotation of the stirring member 160. Since a change in combined capacitance will now be described, attention will be focused on only the developer that moves inside the housing chamber 311S.

First, at a timing where the stirring portion 160*b* passes position T11 in FIG. 6, a large part of the developer is gathered in the interval D between the antenna member 371 and the antenna member 372. In addition, at a timing where a stirring portion 3142 passes position S31 in FIG. 20, a large part of the developer is gathered in the interval D between the antenna member 371 and the antenna member 372. The value of the combined capacitance is largest at this timing. In this case, the position T11 in FIG. 6 and the position S31 in FIG. 20 correspond to time t31 in FIG. 21. As shown in FIG. 21, combined capacitance does not differ between the embodiment and the comparative example at time t31.

At a timing where the stirring portion 160*b* passes position T12 in FIG. 6, a large part of the developer moves away from the interval D between the antenna member 371 and the antenna member 372. Therefore, the combined capacitance drops rapidly. In addition, in FIG. 20 in a similar manner to FIG. 6, at a timing where the stirring portion 3142 passes position S32 in FIG. 20, since a large part of the developer moves away from the interval D, the combined capacitance drops rapidly. In this case, the position T12 in FIG. 6 and the position S32 in FIG. 20 correspond to time t32 in FIG. 21. As shown in FIG. 21, combined capacitance also does not differ between the embodiment and the comparative example at time t32.

At a timing where the stirring portion 160*b* passes position T13 in FIG. 6, a large part of the developer is lifted up by the stirring portion 160*b*. At this point, since the developer moves away from the interval D between the antenna member 371 and the antenna member 372, the combined capacitance becomes smallest. Similarly, in FIG. 20, since a large part of the developer is lifted up by the stirring portion 3142 at a timing where the stirring portion 3142 passes position S33, the developer moves away from the interval D and the combined capacitance becomes smallest. In this case, the position T13 in FIG. 6 and the position S33 in FIG. 20 correspond to time t33 in FIG. 21. As shown in FIG. 21, combined capacitance also does not differ between the embodiment and the comparative example at time t33.

At a timing where the stirring portion 160*b* passes position T14 in FIG. 6, apart of the developer loaded on the stirring portion 160*b* drops to the bottom surface 311B by its own weight. Since the dropped developer gathers at the interval D between the antenna member 371 and the antenna member 372, the combined capacitance slightly increases. Similarly, in FIG. 20 in a similar manner to FIG. 6, at a timing where a stirring portion 3142 passes position S34 in FIG. 20, a part of the developer loaded on the stirring portion 3142 drops to the bottom surface 311B by its own weight and the combined capacitance slightly increases. In this case, the position T14 in FIG. 6 and the position S34 in FIG. 20 correspond to time t34 in FIG. 21. As shown in FIG. 21, combined capacitance also does not differ between the embodiment and the comparative example at time t34.

At this point, in the developing apparatus 140 according to the embodiment, as shown in FIG. 6, the stirring portion 160*b* comes into contact with the contact portion 313 after passing the position 114. As described earlier, the contact portion 313 pushes off the developer on the stirring member 160 so that the developer drops at a faster rate than when dropping from the stirring member 160 by its own weight. Therefore, as shown in FIG. 21, around time t34 (corresponding to the position T14), combined capacitance in the embodiment becomes larger than the combined capacitance according to the comparative example.

On the other hand, in the developing apparatus 3111 according to the comparative example, as shown in FIG. 20, the stirring portion 3142 does not abut the contact portion after passing the position S34. Therefore, in the comparative example, the timing at which the developer drops to the bottom surface 311B becomes slower than in the embodiment and, as shown in FIG. 21, the combined capacitance according to the comparative example becomes smaller than the combined capacitance in the embodiment around time t34 (corresponding to the position S34).

At a timing where the stirring portion 160*b* passes position T15 in FIG. 6, since all of the developer loaded on the stirring portion 160*b* has dropped to the bottom surface 311B and gathers in the interval D between the antenna member 371 and the antenna member 372, the combined capacitance slightly increases. At a timing where the stirring portion 3142 passes position S35 in FIG. 20, since all of the developer loaded on the stirring portion 3142 has dropped to the bottom surface 311B and gathers in the interval D, the combined capacitance slightly increases. In this case, the position T15 in FIG. 6 and the position S35 in FIG. 20 correspond to time t35 in FIG. 21. As shown in FIG. 21, combined capacitance also does not differ between the embodiment and the comparative example at time t35.

Figure 22:
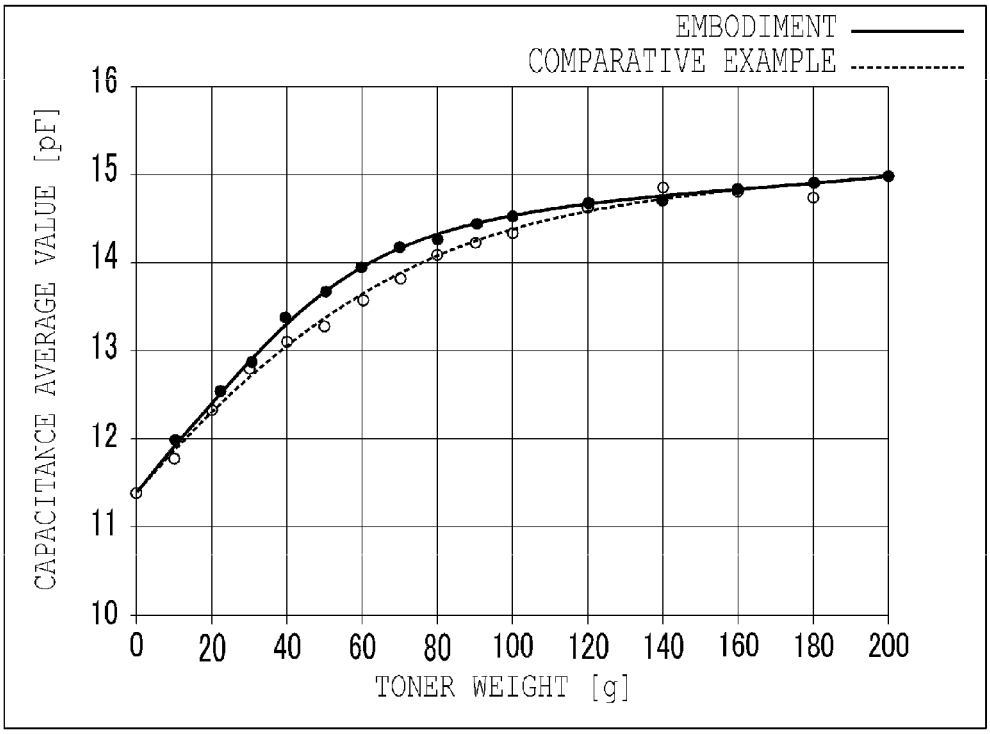
FIG. 22 is a diagram showing a difference in combined capacitance between a fifth embodiment and a comparative example.

Next, an improvement in detection accuracy of a developer amount by increasing the period of time over which developer is positioned in the interval D between the antenna member 371 and the antenna member 372 in the present embodiment will be described. FIG. 22 is a diagram representing a relationship between an average value of combined capacitance and a developer amount. In FIG. 22, combined capacitance according to the present embodiment is depicted by a solid line and combined capacitance according to a comparative example is depicted by a dashed line. As shown in FIG. 22, a change in average values of the combined capacitance in the embodiment is greater than a change in average values of the combined capacitance in the comparative example. In particular, when the amount of developer in the housing chamber 311S (FIG. 19) is around 40 g, the change in the combined capacitance increases. As described earlier, since the larger the amount of change in combined capacitance with respect to an amount of developer, the more accurately the amount of developer can be detected, it is shown that the detection accuracy of a developer amount increases when the amount of developer is around 40 g.

As described above, in the fifth embodiment, the contact portion pushes the developer on the stirring member so that the developer drops at a faster rate than when dropping from the stirring member by its own weight. Accordingly, the developer on the stirring member drops to the bottom surface of the housing chamber at a faster rate than when dropping by its own weight. In addition, a detecting portion for detecting an amount of developer is provided on the bottom surface of the housing chamber and, by increasing a period of time in which the developer is loaded on the bottom surface, a developer amount can be accurately detected even when the amount of the developer becomes small.

In addition, in the fifth embodiment, the contact portion comes into contact with the stirring member so as to gradually narrow a space on the stirring member where the developer can be loaded. Accordingly, as described earlier, the period of time in which the developer is loaded on the bottom surface can be increased and a developer amount can be accurately detected even when the amount of the developer becomes small.

Furthermore, in the fifth embodiment, the contact portion comes into contact with the developer on the stirring member at a position above the stirring shaft of the stirring member. Accordingly, the developer on the stirring member drops from above a rotary shaft of the stirring member and the developer in the housing chamber is sufficiently stirred.

In addition, in the fifth embodiment, when a length from a rotational axis of the stirring member to a tip of the stirring member is denoted by A, a vertically downward distance between the rotational axis to the bottom surface of the housing chamber is denoted by B, and a shortest distance between the rotational axis to the contact portion is denoted by C, $A \geq B$ and $A > C$ are satisfied. Accordingly, the developer loaded on the bottom surface can be sufficiently stirred and, at the same time, a developer amount can be detected with accuracy even when the amount of the developer is small.

Sixth Embodiment

Figure 23:
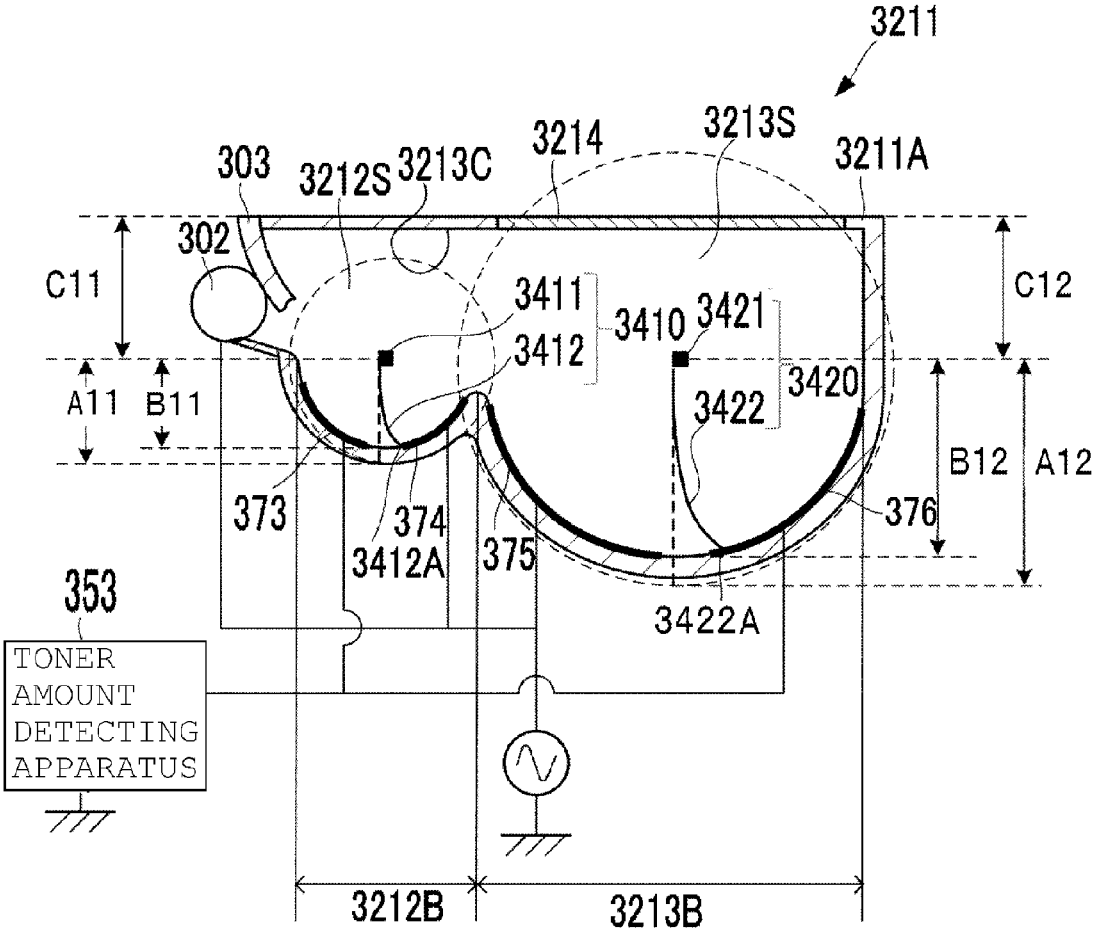
FIG. 23 is a schematic view of a developing apparatus according to a sixth embodiment.
Figure 24:
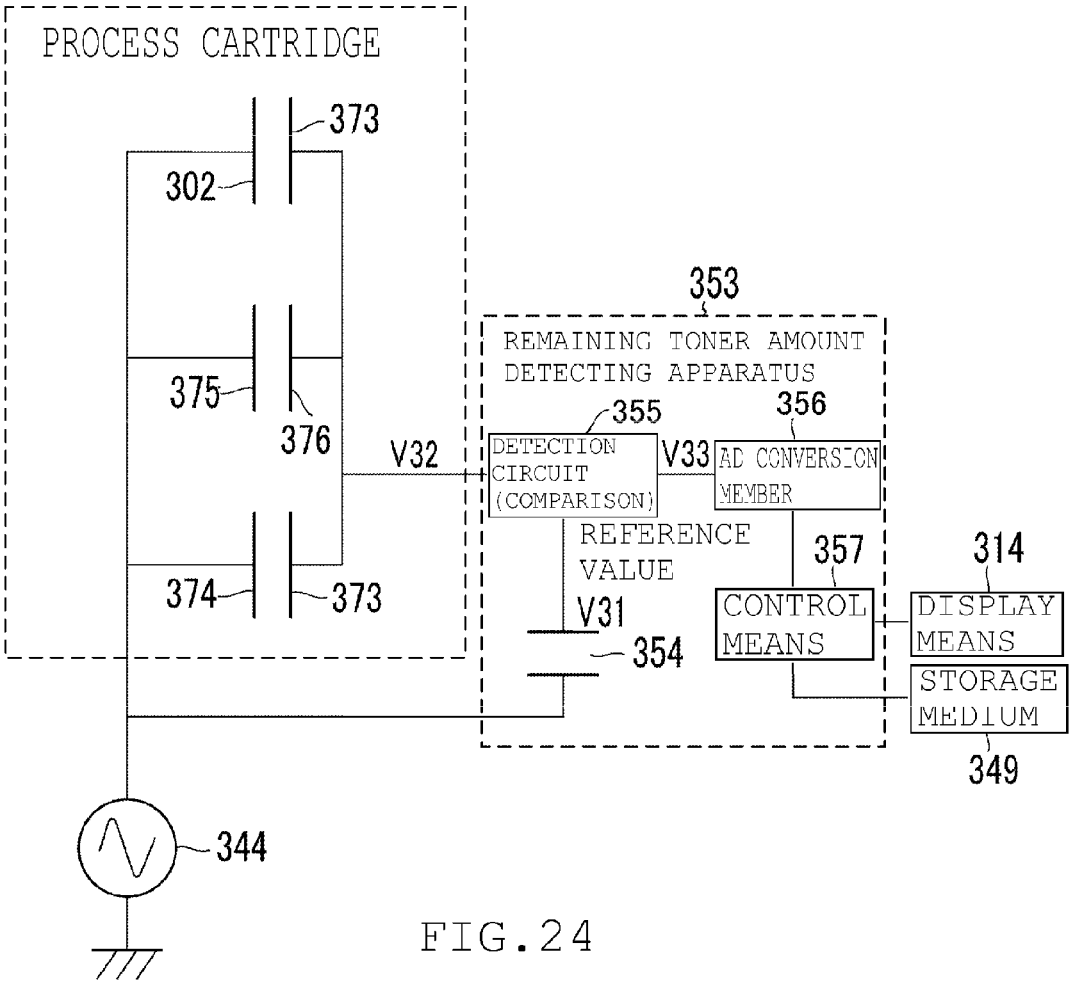
FIG. 24 is a circuit diagram of developer amount detecting means according to the sixth embodiment.

Next, a sixth embodiment of the present invention will be described with reference to FIGS. 23 and 24. FIG. 23 is a schematic view of a developing apparatus according to the sixth embodiment. In addition, FIG. 24 is a circuit diagram of a developer amount detecting apparatus according to the sixth embodiment. Parts of the sixth embodiment which have similar functions to those of the fifth embodiment will be denoted by the same reference characters and a description thereof will be omitted. A developer container 3211A according to the sixth embodiment has an antenna member 373 (third electrode), an antenna member 374 (fourth electrode), an antenna member 375 (fifth electrode), an antenna member 376 (sixth electrode), a first housing chamber 3212S, and a second housing chamber 3213S. In addition, the developer container 3211A includes a contact portion 3214, a first stirring member 3410, and a second stirring member 3420. In this case, the developer container 3211A according to the sixth embodiment is attached to an image forming apparatus in a similar manner to the developer container 311A according to the fifth embodiment. Furthermore, the developer container 3211A according to the sixth embodiment is provided in a developing apparatus and a process cartridge in a similar manner to the developer container 311A according to the fifth embodiment. In this case, the antenna members 373 to 376 constitute detecting portions.

A housing chamber inside the developer container 3211A includes the first housing chamber 3212S and a second housing chamber 3213S. In addition, the first stirring member 3410 is configured by attaching a stirring portion 3412 to a rotary shaft 3411 and rotates around the rotary shaft 3411. The second stirring member 3420 is configured by attaching a stirring portion 3422 to a rotary shaft 3421. Furthermore, the antenna member 373 and the antenna member 374 are used to detect an amount of developer housed in the developer container 3211A. The antenna member 373 is provided on a bottom surface 3212B of the developer container 3211A in the first housing chamber 3212S, and the antenna member 374 is provided on the bottom surface 3212B at an interval from the antenna member 373.

The bottom surface in the developer container 3211A according to the present embodiment is configured to have two depressed portions that are depressed downward in a vertical direction. A space in the developer container 3211A is divided into a space on a near side of the developing roller 302 (the first housing chamber 3212S) and a space on a far side of the developing roller 302 (the second housing chamber 3213S) by a convex portion that protrudes upward in a vertical direction between the two depressed portions on the bottom surface.

The first stirring member 3410 is arranged in the first housing chamber 3212S in the developer container 3211A and stirs toner inside the first housing chamber 3212S so that the toner inside the first housing chamber 3212S is supplied to the developing roller 302. In addition, the second stirring member 3420 is arranged in the second housing chamber 3213S in the developer container 3211A and stirs toner in the second housing chamber 3213S so that the toner in the second housing chamber 3213S moves over the convex portion and into the first housing chamber 3212S.

Furthermore, the antenna member 375 and the antenna member 376 are used to detect an amount of developer housed in the developer container 3211A. The antenna member 375 is provided on a bottom surface 3212B of the developer container 3211A in the second housing chamber 3213S, and the antenna member 376 is provided on the bottom surface 3213B at an interval from the antenna member 375. Moreover, in the sixth embodiment, an amount of developer housed in the developing apparatus 3211 is set to 400 g when the developing apparatus 3211 is not in use. In addition, in the sixth embodiment, the antenna member 373 and the antenna member 374 are provided on the bottom surface 3212B so as to oppose each other, and the antenna member 375 and the antenna member 376 are provided on the bottom surface 3213B so as to oppose each other.

Next, a method of obtaining an amount of developer housed in the housing chamber 3211A based on a change in capacitance between the antenna member 373 and the antenna member 374 and a change in capacitance between the antenna member 375 and the antenna member 376 will be described with reference to FIG. 24. In the sixth embodiment, an AC bias is applied to a reference capacitor 354, the developing roller 302, the antenna member 374, and the antenna member 375 from developing bias applying means 344. Accordingly, a voltage V31 is generated on the reference capacitor 354 and a voltage V23 is generated on the antenna member 373 and the antenna member 374. A detection circuit 355 generates a voltage V33 from a voltage difference between the voltage V31 and the voltage V32 and outputs the voltage V33 to an A/D conversion member 356. The A/D conversion member 356 outputs a result of digital conversion of the analog voltage V33 to control means 357, and the control means 357 determines a developer amount level based on the result. A developer amount is determined based on an average value of output values corresponding to combined capacitance in the circuit from a relationship between output values and developer amounts prepared in advance.

Next, a reason of an improvement of detection accuracy of a developer amount in the developing apparatus according to the sixth embodiment will be described. In the sixth embodiment, a part of a ceiling surface 3213C of the developer container 3211A in the developer container 3211A constitutes a contact portion 3214. In a similar manner to the fifth embodiment, the contact portion 3214 pushes off the developer on the stirring member 3420 so that the developer drops at a faster rate than when dropping from the stirring member 3420 by its own weight.

In FIG. 23, a length A12 represents a length from a rotational axis of the stirring member 3420 to a tip 3422A of the stirring portion 3422 and a distance B12 represents a distance in a vertical direction between the rotational axis of the stirring member 3420 to the bottom surface 3213B of the housing chamber 3213S. In addition, a distance C12 represents a shortest distance from the rotational axis of the stirring member 3420 to the contact portion 3214. In the sixth embodiment, the length A12 is equal to or longer than the distance B12 and the length A12 is longer than the distance C12 in a similar manner to the fifth embodiment.

In addition, a length A11 represents a length from a rotational axis of the stirring member 3410 to a tip 3412A of the stirring portion 3412 and a distance B11 represents a distance in a vertical direction between the rotational axis of the stirring member 3410 to the bottom surface 3212B of the housing chamber 3212S. In addition, a distance C11 represents a shortest distance from the rotational axis of the stirring member 3410 to the ceiling surface 3213C. In the stirring member 3410, the length A11 is equal to or longer than the distance B11 and shorter than the distance C11.

In the sixth embodiment, an interval of the antenna member 373 and the antenna member 374 is shorter than an interval of the antenna member 375 and the antenna member 376. Therefore, a change in capacitance between the antenna member 373 and the antenna member 374 is larger than a change in capacitance between the antenna member 375 and the antenna member 376. In the sixth embodiment, in order to suppress a decline in detection accuracy of a developer amount due to the interval of the antenna member 375 and the antenna member 376 being large, a configuration is adopted in which the rotating second stirring member 3420 abuts the contact portion 3214 that is a part of the ceiling surface 3213C. Moreover, the sixth embodiment adopts such a configuration in order to suppress a decline in developer detection accuracy when a developer amount in the developer container 3211A is around 100 to 200 g.

Figure 25:
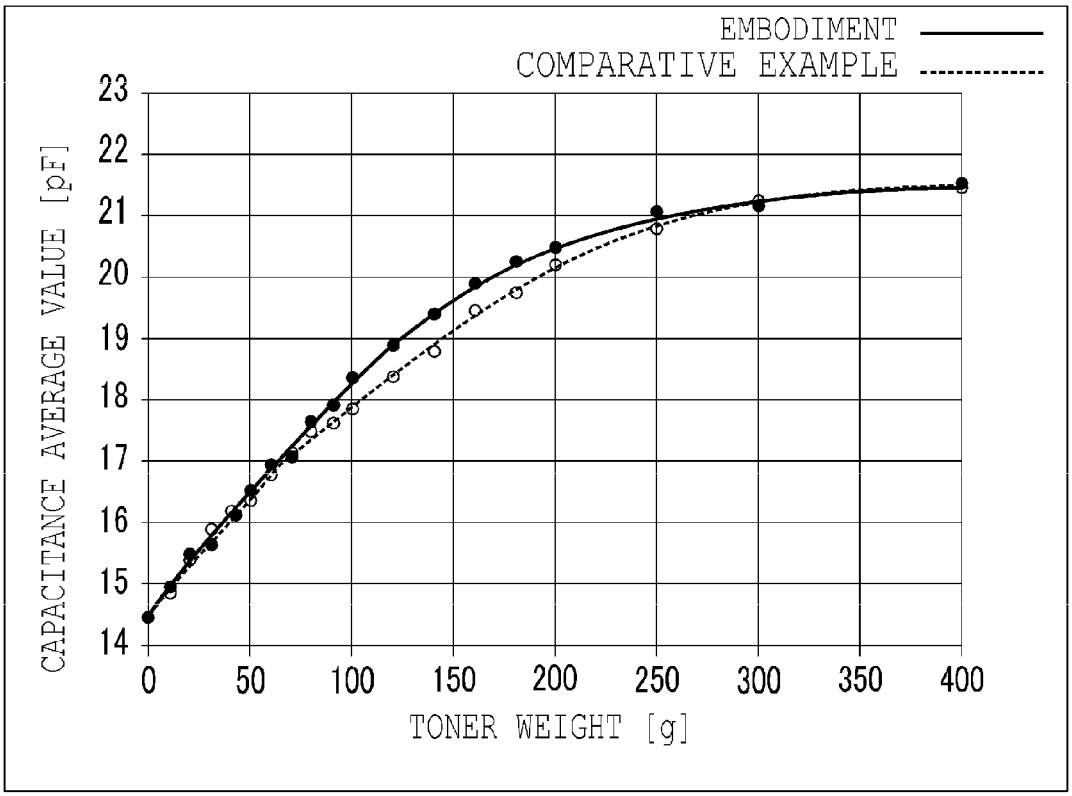
FIG. 25 is a diagram showing a difference in combined capacitance between the sixth embodiment and a comparative example.

FIG. 25 is a diagram showing a relationship between a developer amount in the developer container 3211A and combined capacitance according to the sixth embodiment. In this case, the combined capacitance is capacitance that combines capacitance between the developing roller 302 and the antenna member 373, capacitance between the antenna member 373 and the antenna member 374, and capacitance between the antenna member 375 and the antenna member 376. As shown in FIG. 25, even in the sixth embodiment, when the amount of developer in the developer container 3211A is small, an amount of change in average output of combined capacitance is increased and detection accuracy of a developer amount is improved.

As described above, the sixth embodiment is capable of producing a similar effect to the fifth embodiment. In addition, in the sixth embodiment, developer detection accuracy when a developer amount in the developer container is around 100 to 200 g can be improved as described earlier.

Moreover, while a developer amount in a developer container is detected based on a change in capacitance in the respective embodiments, a method of detecting a developer amount is not limited thereto. For example, a developer amount in a housing chamber may be acquired by irradiating the inside of a developer container with detection light. In this case, the first electrode is replaced with a first light guiding member that guides detection light into the housing chamber and the second electrode is replaced with a second light guiding member that guides the detection light guided into the housing chamber by the first light guiding member to a light receiving member outside of the housing chamber. In addition, an amount of developer housed in the housing chamber is acquired by measuring a time at which the detection light reaches the light receiving member.

Alternatively, a developer amount in the developer container may be obtained by measuring duty of a capacitance profile while the stirring member makes one round. In this case, a determination that a toner amount in the developer container is large is made when the period of time at which capacitance is on a + signal side is long while the stirring member makes one round. Since the period of time at which combined capacitance exceeds a threshold differs depending on a toner amount in the developer container, a toner amount can be obtained by measuring the period of time at which combined capacitance exceeds a threshold.

Seventh Embodiment

<Initial Capacitance Detecting Method>

In the configuration described so far, due to a stirring operation of developer, a state where developer in an area of the gap X1 (FIG. 1) is well mixed with air due to stirring and a state where air has escaped due to the developer's own weight in the developer container are alternately repeated. In addition, due to the gap X1 being below the stirring portion 160*b*, states where air is included and air is not included due to the developer's own weight can be determined with higher accuracy. However, the present configuration is susceptible to a state (tapping) where air in the developer has significantly escaped due to vibration during transportation or the like. In consideration thereof, in the present embodiment, a description will be given on a method of controlling detection of a remaining amount which is also capable of reducing the effect of tapping due to vibration during transportation or the like using the configuration of remaining amount detection in which an electrode member positioned below a stirring shaft is provided.

Specifically, tapping occurs during transportation of a developer container, a developing apparatus, a process cartridge, or an image forming apparatus when vibration due to distribution coincides with long-term standing to cause air inside the developer escape s significantly prior to installation by a user.

Figure 27A:
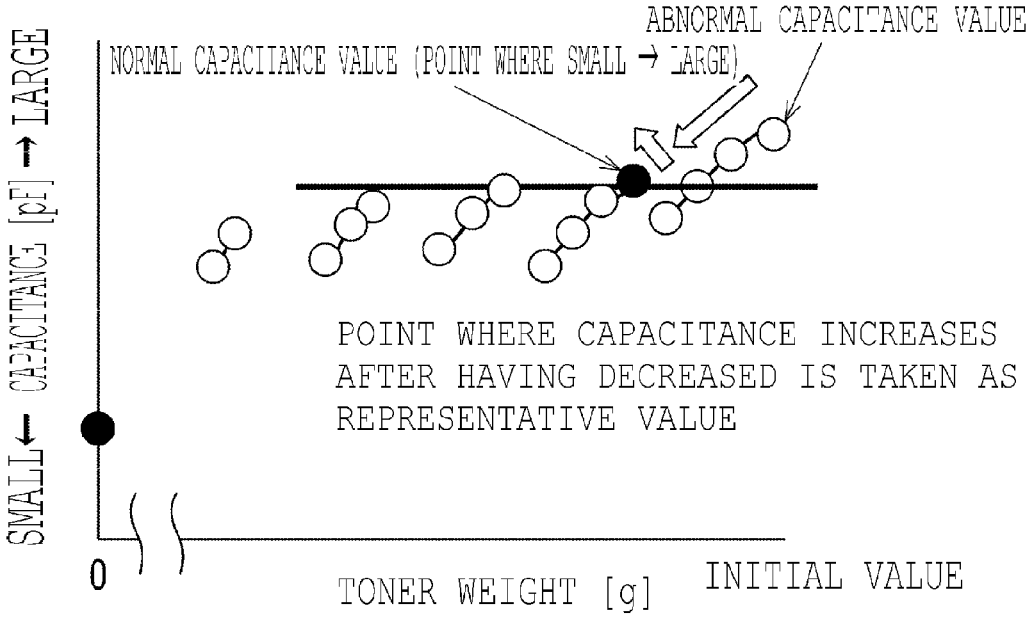
FIGS. 27A and 27B are diagrams representing changes in developer amount and capacitance according to a seventh embodiment and a conventional example.
Figure 27B:
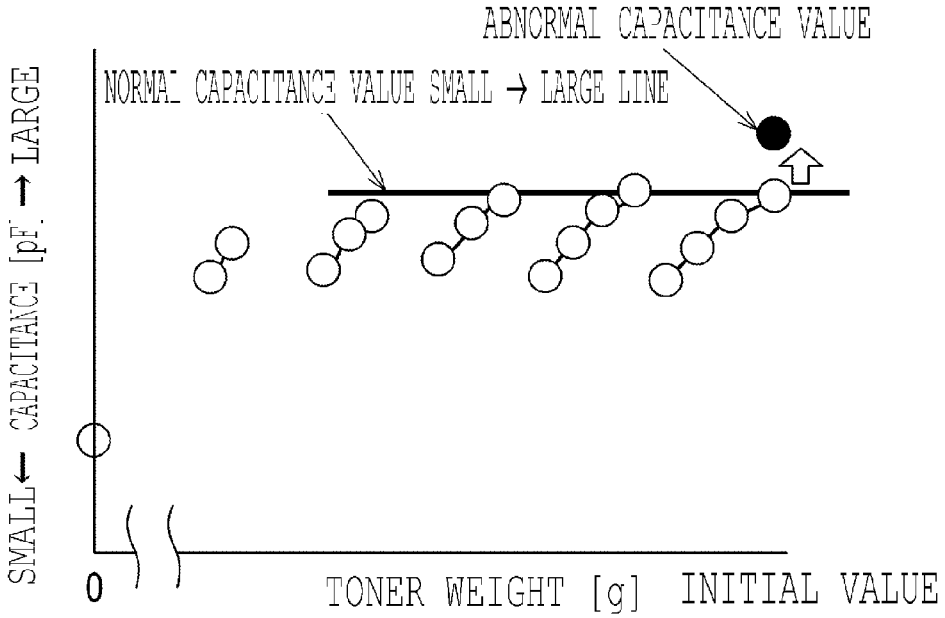

When the user performs image formation in this state as shown in FIG. 27B, an initial remaining amount detection is to be started in a tapped state. As a result, with the present configuration which includes an electrode member below a stirring member, capacitance appears to have a significantly large value.

Consequently, a difference between a highest capacitance value (a capacitance value influenced by tapping) obtained in a detection area in an initial stage of a durability test and capacitance detected at a predetermined durability test timing ends up being detected. Accordingly, when calculating a developer amount based on the detected value and a threshold of a remaining amount %, an abnormally large capacitance value is detected.

In addition, since a greater-than-expected difference is created when detecting a remaining amount in a later stage of a durability test, a notification is made that the remaining developer amount is smaller than normal or, in other words, that the remaining amount is decreasing at a faster rate.

In consideration thereof, in the present embodiment, as shown in FIG. 27A, instead of calculating a developer amount based on a highest capacitance value obtained in a tapped initial state (a state where the image forming apparatus is brand new), stirring is performed once to cause developer in the area of the gap X1 to circulate inside the developer container. As a result, capacitance gradually decreases from an abnormally large value due to stirring of the developer causing air to be well mixed with the developer. Then, in a stage where T stirring is stopped, air escapes due to the developer's own weight and a large capacitance value is obtained.

Unlike the capacitance value when subjected to tapping, the capacitance value at this point is a highest value among normal initial values of capacitance in a state of normal use by the user after installation of the main body (state immediately after the start of use of the image forming apparatus). The present embodiment adopts a configuration in which this value is detected as a representative value for calculating a remaining toner amount. In other words, the effect of vibration during distribution is not resolved unless a T stirring operation is performed. Therefore, by monitoring an initial change in capacitance and calculating a remaining toner amount by comparing a capacitance value having temporarily decreased and subsequently increased as a representative value with a capacitance value at a predetermined timing, a remaining toner amount can be detected on toner freed from tapping.

Moreover, since a state freed from tapping as described above occurs after the main body is installed and is no longer affected by distribution, when the amount of toner in the detection area is largest even during a durability test, a normal capacitance value as though obtained during normal use can be detected.

In consideration thereof, as a specific control method according to the present embodiment, detection of capacitance is started at the gap X1 from an initial stage and a decline in the capacitance value as passage of paper advances is monitored. Subsequently, remaining amount detection can be performed more accurately by determining a representative value of the capacitance value when capacitance increases, detecting a difference between the representative value and capacitance detected at a predetermined durability test timing, and calculating a developer amount based on the detected value and a threshold of remaining amount %.

The seventh embodiment and a comparative example 2 that is a conventional configuration will now be compared and described with reference to Table 1. Comparative example 2 is a conventional configuration in which an electrode member is provided in a stirred container. Since the state of developer does not stabilize (toner in a capacitance detection area is affected by stirring) in this configuration, it is difficult to detect a developer amount with high accuracy. However, with the present configuration, by providing the gap X1 using a plurality of electrodes on a bottom portion of a stirred area, a change in capacitance when a toner amount is small can be increased, and an advantage is gained in that accuracy of developer amount detection can be improved when the toner amount is small.

TABLE 1

| | CONFIGURATION | ACCURACY OF REMAINING AMOUNT DETECTION | EFFECT OF TAPPING |
|---|---|---|---|
| PRESENT EMBODIMENT | ELECTRODE 1 AND ELECTRODE 2 ARRANGED BELOW STIRRER DETECT CAPACITANCE SMALL → LARGE (REPRESENTATIVE VALUE) | ○ (A) | ○ (A) |
| COMPARATIVE EXAMPLE 2 | ELECTRODES ARRANGED AT LOCATION WHERE DEVELOPER AMOUNT IS 0 | Δ (B) | Δ (B) |

In addition, regarding the effect of tapping, since comparative example 2 is less likely to detect a degree of mixing of developer and air due to stirring, it is difficult to accurately detect a developer amount. In contrast, in the present embodiment, electrodes are provided below stirring where a change in capacitance becomes prominent and states where air is included and air is not included due to the developer's own weight can be determined more accurately and in a shorter amount of time. Furthermore, since a point where capacitance increases after a capacitance value declines in an initial state of a durability test is detected as a representative value of the capacitance value, an accuracy of remaining amount detection can be improved regardless of a durability test timing.

Moreover, while vertical axes in FIGS. 27A and 27B represent capacitance, this capacitance combines capacitance in a measurement system of apparatuses other than the developing apparatus in addition to capacitance between electrodes and therefore is a value dependent on the measurement system. Therefore, the values shown in the present specification are numerical values limited to the measurement system used by the present inventors in experiments or the like. However, since a comparison of relative changes in capacitance is sufficient for the purpose of verifying the effect of the present invention, the values are used as examples that demonstrate the effect of the present invention. In addition, the values shown in the present specification are numerical values limited to the measurement system used by the present inventors in experiments or the like. However, since a comparison of relative changes in capacitance is sufficient for the purpose of verifying the effect of the present invention, the values are used as examples that demonstrate the effect of the present invention.

According to the present invention, a developer container, a developing apparatus, a process cartridge, and an image forming apparatus which enable a developer amount to be detected at high accuracy can be provided.

Eighth Embodiment

The present eighth embodiment differs from the seventh embodiment in the method of calculating a representative value of initially detected capacitance. Hereinafter, differences from the seventh embodiment will be described and matters that are similar to those of the seventh embodiment will not be described.

Figure 28A:
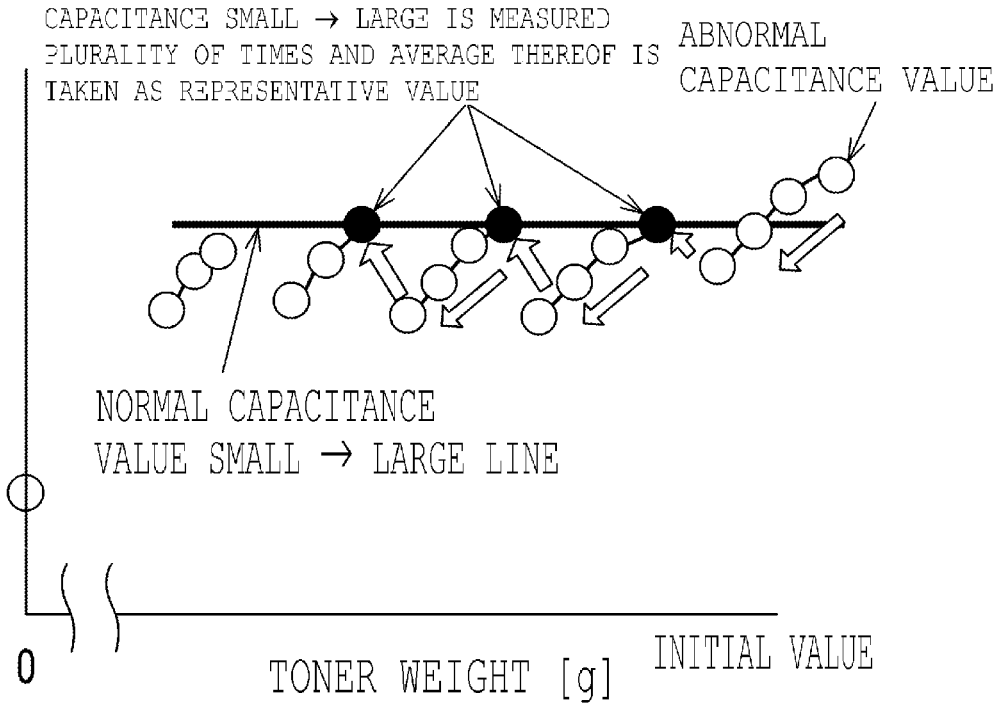
FIGS. 28A and 28B are diagrams representing changes in developer amount and capacitance according to an eighth embodiment and a ninth embodiment.

FIG. 28A is a diagram showing a relationship between a developer amount and capacitance according to the present embodiment. The eighth embodiment is the same as the seventh embodiment up to the detection of a capacitance value representing capacitance having increased after decreasing when detecting initial developer in a detection area of the gap X1 (FIG. 1). Subsequently, in the present embodiment, a measurement of increased capacitance after the capacitance value decreases following the initial detection is performed a plurality of times and, for each measurement, a value when capacitance increases is obtained in plurality. In addition, a remaining toner amount % is calculated using an average value of the obtained plurality of capacitance values as a reference value. An advantage of this embodiment is that, in addition to the seventh embodiment, even when flowability of developer in the detection area occurs in an initial state of a durability test, results of a plurality of measurements of increased capacitance after the capacitance value decreases can be reflected to the calculation of a remaining toner amount %. Therefore, a representative value of initial capacitance values can be accurately calculated.

Ninth Embodiment

The present embodiment differs from the seventh present embodiment in the method of calculating a maximum value of capacitance values. Hereinafter, differences from the seventh embodiment will be described and matters that are similar to those of the seventh embodiment will not be described.

Figure 28B:
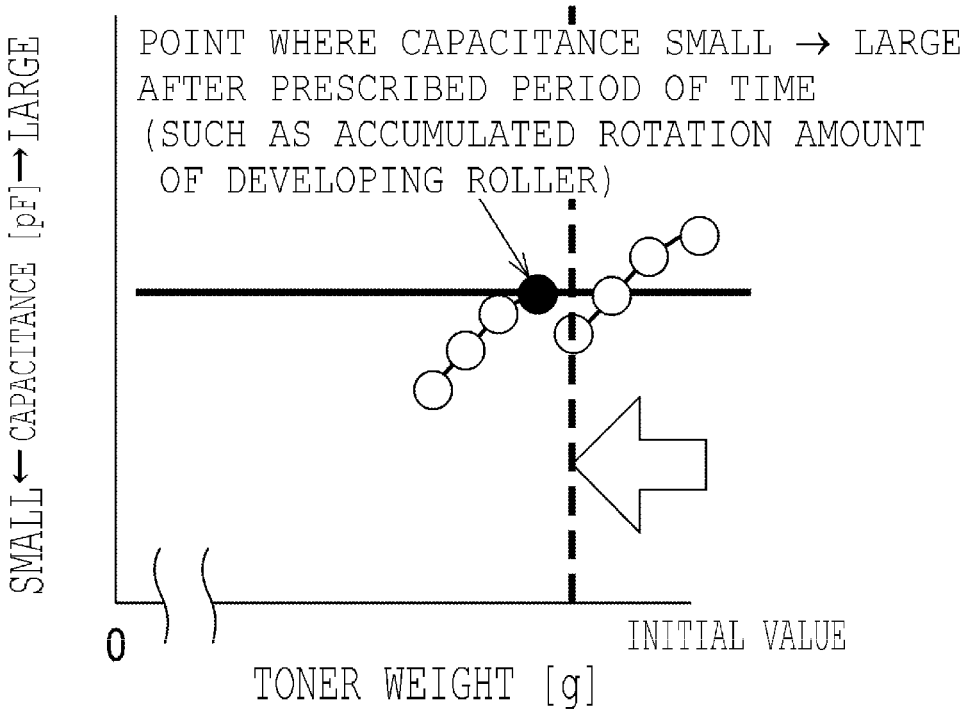

FIG. 28B is a diagram showing a relationship between a developer amount and capacitance according to the present embodiment. The ninth embodiment is the same as the seventh embodiment up to the detection of a capacitance value representing capacitance having increased after decreasing when detecting initial developer in a detection area of the gap X1 (FIG. 1). In doing so, in the present embodiment, after driving a developing roller or a stirring member for a predetermined period of time in order to perform image formation as shown in FIG. 28B, a remaining toner amount % is calculated using a capacitance value representing capacitance having increased after the capacitance value had decreased as a representative value. An advantage of this embodiment is that, in addition to the seventh embodiment, since capacitance can be detected in accordance with driving of the developing roller or driving of stirring in a vicinity of electrodes, capacitance can be measured after actually stirring developer. In other words, even when capacitance changes from small to large due by an erroneous detection due to electric noise or the like when a predetermined amount of driving of the developing roller or driving of stirring is being performed, a representative value can be calculated by detecting capacitance after actually stirring the developer.

Moreover, in the embodiment described above, the contact portion 313 according to the fifth embodiment can be provided in the toner chamber 147 according to the first embodiment. In addition, in the embodiment described above, the method of acquiring a toner amount according to the seventh to ninth embodiments can be adopted for the toner chamber 147 according to the first embodiment. Furthermore, in other embodiments, configurations of the respective embodiments can also be combined with configurations of other embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-017025, filed on Jan. 30, 2015, Japanese Patent Application No. 2015-017226, filed on Jan. 30, 2015, Japanese Patent Application No. 2015-016253, filed on Jan. 30, 2015 and Japanese Patent Application No. 2015-243270, filed on Dec. 14, 2015, which are hereby incorporated by reference herein in its entirety.

What is claimed is:

1. A developing apparatus comprising:

a developer bearing member for bearing developer;

a frame housing the developer;

a stirring member including a sheet-like stirring portion and a rotary shaft to which the sheet-like stirring portion is attached; and a first electrode and a second electrode which are used to detect an amount of the developer and which are arranged with an interval therebetween, wherein an area between the first electrode and the second electrode in a surface of the frame is positioned below the rotary shaft of the stirring member and below a lower end of the developer bearing member, and wherein the sheet-like stirring portion comes into contact with the first electrode, with the second electrode, and with the area due to rotation of the stirring member.

2. The developing apparatus according to claim 1, wherein the first electrode and the second electrode are positioned below the rotary shaft of the stirring member.

3. The developing apparatus according to claim 1, wherein the area is an area including a lowermost position in the frame.

4. The developing apparatus according to claim 1, wherein the first electrode, the second electrode, and the area are arranged in an order of the second electrode, the area, and the first electrode in a rotational direction of the stirring member below a center of the rotary shaft.

5. The developing apparatus according to claim 1, wherein the first electrode and the second electrode are sheet-like conductive members installed along a wall surface of the frame.

6. The developing apparatus according to claim 1, wherein the frame is divided into a first housing area and a second housing area from a side of an opening of the frame toward a distal side, wherein the stirring member is a first stirring member that is rotatably provided in the first housing area, wherein the developing apparatus further comprises a second stirring member that is rotatably provided in the second housing area, wherein the first electrode and the second electrode are arranged in the first housing area, and wherein the developing apparatus further comprises a third electrode and a fourth electrode which are used to detect an amount of the developer and which are arranged with an interval therebetween in the second housing area.

7. The developing apparatus according to claim 6, wherein the second electrode and the third electrode are a single electrode member arranged so as to straddle the first housing area and the second housing area.

8. The developing apparatus according to claim 6, wherein the first electrode is positioned below a rotary shaft of the first stirring member, and wherein the fourth electrode is positioned below a rotary shaft of the second stirring member.

9. The developing apparatus according to claim 6, wherein the area is a first area in the first housing area, and wherein the second stirring member comes into contact with a second area between the third electrode and the fourth electrode in the second housing area due to rotation.

10. The developing apparatus according to claim 6, wherein the first housing area and the second housing area are divided by a convex portion that protrudes upward in a vertical direction on a wall surface forming the frame.

11. The developing apparatus according to claim 1, wherein the frame includes an opening, and wherein a lower end of the opening is positioned above the rotary shaft.

12. The developing apparatus according to claim 1, further comprising:

a detecting portion for detecting an amount of the developer; and a contact portion which is capable of coming into contact with the rotating stirring member so as push off developer on the stirring member such that the developer drops at a faster rate than when the developer drops from the stirring member by its own weight.

13. The developing apparatus according to claim 1, wherein a difference between an initial value that is a value of capacitance between the first electrode and the second electrode immediately after start of a new image forming process using the developing apparatus and a value of the capacitance at a predetermined timing is acquired, wherein a remaining amount of developer in the frame is acquired based on the difference, and wherein the initial value is a value of the capacitance acquired after the developer in the frame is stirred by the stirring member.

14. The developing apparatus according to claim 13, wherein the initial value is a maximum value of the capacitance in a case where the capacitance increases after a temporary decrease.

15. The developing apparatus according to claim 13, wherein the initial value is an average value of maximum values of the capacitance while the stirring member makes one round immediately after the start of the new image forming process.

16. The developing apparatus according to claim 13, wherein the initial value is a value of the capacitance after a developer bearing member that bears developer for developing an electrostatic latent image and the stirring member are driven for a predetermined period of time and is a maximum value of the capacitance while the stirring member makes one round.

17. A process cartridge that can be detachable from an apparatus main body of an image forming apparatus, the process cartridge comprising:

the developing apparatus according to claim 1; and an image bearing member that bears an electrostatic image to be developed by developer.

18. An image forming apparatus which forms an image on a recording material using developer, wherein the developing apparatus according to claim 1 is configured to be detachable from a main body of the image forming apparatus.

19. The developing apparatus according to claim 1, wherein the first and second electrodes are used to detect the amount of the developer by using a capacitance between the first electrode and the second electrode.

* * * * *